US008210147B2

(12) United States Patent
Cotton

(10) Patent No.: US 8,210,147 B2
(45) Date of Patent: Jul. 3, 2012

(54) SLIDING VALVE ASPIRATION SYSTEM

(75) Inventor: Gary W. Cotton, Ward, AR (US)

(73) Assignee: Grace Capital Partners, LLC, Little Rock, AR (US)

( * ) Notice: Subject to any disclaimer, the term of this patent is extended or adjusted under 35 U.S.C. 154(b) by 689 days.

(21) Appl. No.: 12/387,184

(22) Filed: Apr. 29, 2009

(65) Prior Publication Data

US 2010/0012071 A1 Jan. 21, 2010

Related U.S. Application Data

(60) Provisional application No. 61/135,267, filed on Jul. 18, 2008.

(51) Int. Cl.
*F01L 5/00* (2006.01)

(52) U.S. Cl. ..... 123/188.4; 123/188.5

(58) Field of Classification Search ..... 123/188.4, 123/188.5

See application file for complete search history.

(56) References Cited

U.S. PATENT DOCUMENTS

| | | | | |
|---|---|---|---|---|
| 1,069,794 | A | 8/1913 | Lazier | |
| 1,114,521 | A | 10/1914 | Platt | |
| 1,142,949 | A | 6/1915 | Fay | |
| 1,169,353 | A | 1/1916 | Reeve | |
| 1,169,354 | A | 1/1916 | Reeve | |
| 1,286,967 | A | 12/1918 | Eschwei | |
| 1,550,643 | A | 8/1925 | Bullington | |
| 1,640,958 | A | 8/1927 | Nelson | |
| 1,777,792 | A | 10/1930 | Grace | |
| 1,794,256 | A | 2/1931 | Stuart | |
| 1,855,634 | A | 4/1932 | Ingalls | |
| 1,856,348 | A | 5/1932 | McMillan | |
| 1,890,976 | A | 12/1932 | Erickson | |
| 1,905,140 | A | 4/1933 | Boyce | |
| 1,942,648 | A | 1/1934 | Jensen | |
| 1,995,307 | A | 3/1937 | Hickey | |
| 2,080,126 | A | 5/1937 | Gibson | |
| 2,160,000 | A | 5/1939 | Rhein | |
| 2,164,522 | A | 7/1939 | Howard | |
| 2,021,292 | A | 5/1940 | Hickey | |
| 2,302,442 | A | 11/1942 | Hickey | |
| 3,522,797 | A * | 8/1970 | Stinebaugh | 123/317 |
| 3,533,429 | A | 10/1970 | Shoulders | |
| 5,579,730 | A | 12/1996 | Trotter | |
| 6,006,714 | A | 12/1999 | Griffin | |
| 6,776,129 | B2 | 8/2004 | Diehl | |
| 7,089,893 | B1 | 8/2006 | Ostling | |
| 7,263,963 | B2 * | 9/2007 | Price | 123/188.4 |
| 7,264,964 | B2 | 9/2007 | Dang | |
| 8,108,995 | B2 * | 2/2012 | Price | 29/888.06 |

* cited by examiner

*Primary Examiner* — Noah Kamen
*Assistant Examiner* — Grant Moubry
(74) *Attorney, Agent, or Firm* — Stephen D. Carver

(57) ABSTRACT

An internal combustion engine uses separate, tubular and hollow reciprocating sleeve valves that open and close intake and exhaust passageways for improved aspiration. The sliding sleeve valves are disposed within sleeves horizontally disposed within a modified head secured above the combustion chamber. The valves are driven in a path normal to the engine pistons by an independent crankshaft that is rotated through an external pulley driven by the engine crankshaft. Fluid flow occurs through the valve interior and through ports dynamically positioned above the compression cylinder, proximate aligned sleeve and head ports. Sleeve ports are separated by bridges that maintain valve rings in compression during reciprocation to prevent damage. Each valve body has a reduced diameter midsection forming a relief annulus that distributes shearing pressures about the circumference of the valve. High pressure gas is confined between axially spaced apart, stepped sealing rings that prevent gases from flowing axially about the valve exterior.

40 Claims, 23 Drawing Sheets

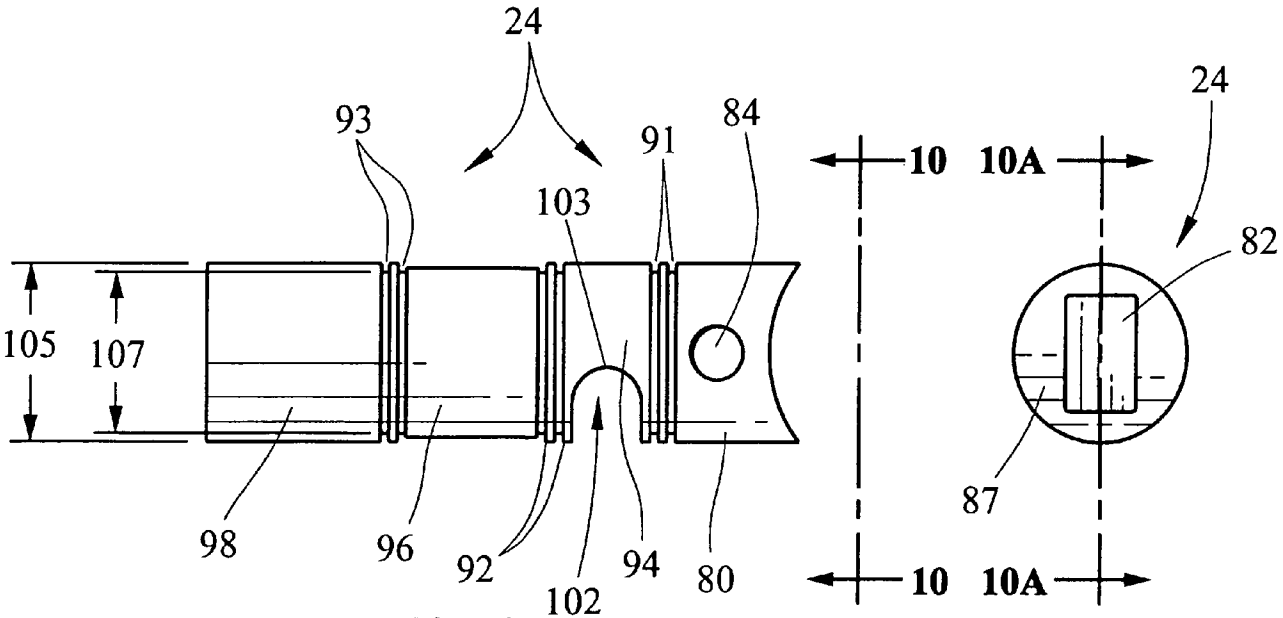
Fig. 10
Fig. 9
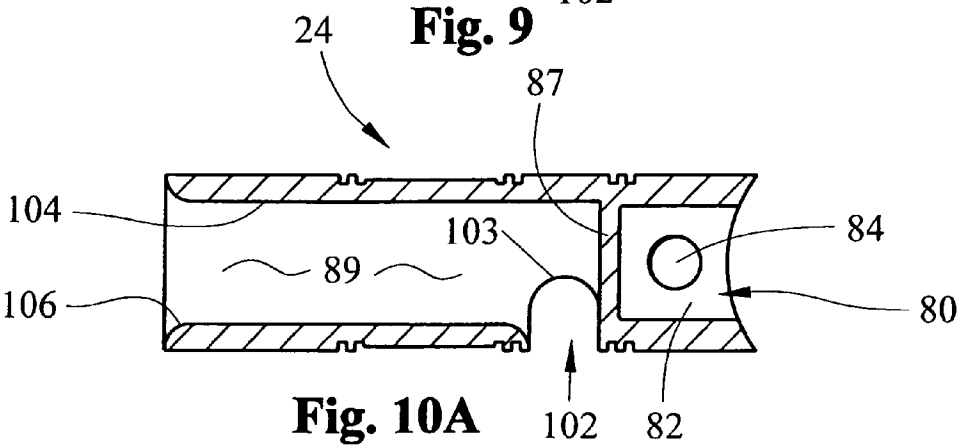
Fig. 10A

Beginning of Intake Stroke

Intake Valve Open at 108°

End of Intake Stroke

Beginning of Power Stroke

Bottom of Power Stroke

End of Exhaust Stroke

Exhaust Valve at
Start of Exhaust Stroke

Exhaust Valve
Fully Open 251°

Exhaust Valve Beginning Closure at Beginning of Intake Stroke 222°

Exhaust Valve Closed at Bottom of Intake Stroke 180°

Exhaust Valve 90° into Compression Stroke

Exhaust Valve at 0° TDC

SLIDING VALVE ASPIRATION SYSTEM

CROSS REFERENCE TO RELATED APPLICATION

This utility patent application is based upon, and claims the filing date of, prior U.S. Provisional application entitled "Sliding Valve Aspiration Engine," Ser. No. 61/135,267, filed Jul. 18, 2008, by inventor Gary W. Cotton.

BACKGROUND OF THE INVENTION

1. Field of the Invention

The present invention relates generally to sleeve valve systems for aspirating internal combustion engines, and to internal combustion engines with tubular sliding valves for enhanced aspiration. More particularly, the present invention relates to reciprocating sleeve valve systems and engines equipped therewith of the general type classified in United States Patent Class 123, Subclasses 84, 188.4, and 188.5.

2. Description of the Related Art

A variety of aspiration schemes are recognized in the internal combustion motor arts. In a typical four-cycle firing sequence, gases are first inputted and then withdrawn from the combustion chamber of each cylinder interior during reciprocating piston movements caused by the crankshaft. Gas pathways must be opened and closed during a typical cycle. During the intake stroke, for example, an air/fuel mixture is suctioned through an open intake passageway into the combustion chamber as the piston is drawn downwardly within the cylinder. The intake passageway is typically opened and closed by some form of reciprocating valve mechanism that is ultimately driven by mechanical interconnection to the crankshaft. The combustion chamber must be sealed during the following compression and power strokes, and the valve mechanisms must be closed to block the ports. During the following exhaust stroke, exhaust ports must be opened to discharge spent gases from the combustion chamber.

Spring-biased poppet valves are the most common form of internal combustion engine valve. Typically, poppet valves associated with the intake and exhaust passageways are seated within the cylinder head above the combustion chamber proximate the cylinder and piston. Typical reciprocating poppet valves are spring biased, assuming a normally closed position when not deflected. In a typical arrangement, the bias spring coaxially surrounds the valve stem to maintain the integral valve within the matingly-configured valve seat. Poppet valves are typically opened by mechanical deflection from valve train apparatus driven by camshafts. Typical overhead-valve motor designs include rocker arms comprising reciprocating levers driven by push rods in contact with camshaft lobes. When the camshaft lobe deflects a pushrod to raise one end of the rocker arm, the opposite arm end pivots downwardly and opens the valve. When the camshaft rotates further, the rocker arm relaxes and spring pressure closes the valve. With overhead-cam designs camshafts are disposed over the valves above the head, and valve deflection is accomplished without push rods or rocker arms. Overhead camshafts push directly on the valve stem through cam followers or tappets. Some V-configured engines use twin overhead camshafts, one for each head. Some enhanced DOHC designs use two camshafts in each head, one for the intake valves and one for the exhaust valves. The camshafts are driven by the crankshaft through gears, chains, or belts.

Despite the overwhelming commercial success of poppet-valve designs, there are numerous deficiencies and disadvantages associated with poppet valves. Although poppet valve designs provide manufacturing advantages and cost savings, substantial spring pressure must be repeatedly overcome to properly open the valves. Spring pressure results in considerable drag and friction which increases fuel consumption and limits engine RPM. Poppet valve heads are left within the fluid flow passageway, despite camshaft deflection, and the resulting obstruction in the gas flow pathway promotes inefficiency. For example, back pressure is increased by the valve mass obstructing fluid flow, which contributes to turbulence. Poppet valves are exposed to high combustion chamber temperatures, particularly during the exhaust stroke, that can promote deformation and wear. Thermal expansion of exhaust valves, for example, can interfere with proper valve seating and subsequent sealing, which can decrease combustion performance.

Many of these disadvantages are amplified in high-horsepower or "high R.P.M." applications. Valve deflection in high power applications is often extreme, increasing the amplitude of valve defection or travel. Damaging valve-to-piston contact can result. As a means of attenuating the latter factor, some pistons are designed with valve clearance regions, but these piston surface irregularities can deleteriously affect the combustion charge and fluid flow through the combustion chamber. Another problem is that the applied drive forces experienced by the valves are asymmetric. The extreme forcing pressure applied by the camshaft to open the valves, for example, is not as uniform as the spring closing pressure. Disharmony between the opening and closing forces contributes to valve lash and concomitant timing problems that interfere with power generation and limit engine R.P.M. Of course, in high power systems involving four or more valves per cylinder, the problems and disadvantages with poppet valve engines are increased proportionally.

So-called "rotary valves" have been proposed for replacing reciprocal poppet valves. Typical rotary valve designs include an elongated tube or cylinder machined with a plurality of gas flow passageways that admit or pass gases. The rotary valves are not reciprocated; the are rotated about their axis to expose passages defined in them in directions normal to their longitudinal axis. Rotary valves must be timed properly to dynamically align their internal passageways with the fluid flow paths of the engine during operation. When rotated to a closing position, the rotary valve passageways are radially displaced, obstructing the normal flow pathways and sealing the engine for firing or compression strokes.

One advantage espoused by rotary valve proponents is the relative simplicity of the design. Further, rotary valves do not penetrate or extend into the cylinder, avoiding potential mechanical contact with the piston, and minimizing fluid flow obstructions. However, the biggest problem with rotary valves relates to ineffective sealing. Although much activity and research has been directed to rotary valve sealing designs, commercially feasible systems have not been perfected. Rotary systems provide inefficient cylinder sealing, lessening firing efficiency, and reducing compression pressure because of leakage. Further, rapid wear of such systems increases the aforementioned problems.

Sliding valves of many configurations are also known in the art. Typical slide valves may be hollow and tubular, or planar, or cylindrical. They are reciprocated within a tubular valve seat region proximate the combustion chamber to alternately open and then close the intake and exhaust passageways. Like rotary valves, sliding valve designs have hitherto been difficult to seal effectively, with predictable negative results.

U.S. Pat. No. 2,080,126 issued May 11, 1937 to Gibson shows a sliding valve arrangement involving a tubular valve driven by a secondary crankshaft. Its reciprocating axis is parallel to the axis of piston deflection. Ports arranged at the side of the piston are alternately opened and closed by piston movements, and gases are conducted through and around portions of the piston exterior.

A similar arrangement is seen in U.S. Pat. No. 1,995,307 issued Mar. 26, 1935, and U.S. Pat. No. 2,201,292, issued May 21, 1940, both to Hickey. The latter patents show designs that aspirate a single working cylinder with a pair of tubular, reciprocating valves that are mounted on either side of the piston and driven by secondary crankshafts. The aspirating valves are forcibly reciprocated between port blocking and port aligning positions. The valves are aligned at an angle slightly off of parallel with the axis of the cylinder.

Other examples of engines with tubular, reciprocating slide valves that move in a direction generally parallel with the drive piston axis are provided by U.S. Pat. Nos. 1,069,794; 1,142,949; 1,777,792; 1,794,256; 1,855,634; 1,856,348; 1,890,976; 1,905,140; 1,942,648; 2,160,000; and 2,164,522 that are largely cumulative.

Hickey U.S. Pat. No. 2,302,442 issued Nov. 17, 1942 shows a tubular, reciprocating sliding valve disposed atop a piston head. The valve slides in an axis generally perpendicular to the axis of the lower drive piston.

U.S. Pat. No. 5,694,890 issued to Yazdi on Dec. 9, 1997 and entitled "Internal Combustion Engine With Sliding Valves" discloses an internal combustion engine aspirated by slidable valves. Tapered, horizontally disposed valve seats are defined near inlet and exhaust ports at the top of the combustion chambers. The slidable valves are tapered to conform to the valve seats. Valve movement is caused by a crankshaft driving a rocker arm that is oriented substantially orthogonal to the rod, whereby crankshaft rotation is translated into horizontal, sliding movements of the planar valves, which reciprocate in a direction normal or transverse to the axis of the piston.

U.S. Pat. No. 7,263,963 issued to Price on Sep. 4, 2007 and entitled "Valve Apparatus For An Internal Combustion Engine" discloses a cylinder head with a cam-driven valve slidably disposed within a valve pocket. The valve, which is displaceable along its longitudinal axis has a tapered portion defining multiple fluid flow passageways. The valve is displaced by cam rotation between a configurations passing gases through the passageways and a configuration wherein the valve flow passageways are closed.

BRIEF SUMMARY OF THE INVENTION

This invention provides an improved sliding valve system for aspirating internal combustion engines, and engines equipped therewith. The system employs tubular, reciprocating sliding valves disposed within sleeves defined within the head secured above the motor's reciprocating pistons. The valves are driven by an independent crankshaft that is exteriorly driven through a pulley.

The sliding valves are positioned within suitable exhaust and intake tunnels in the head. Preferably sleeves are concentrically disposed around the valves and concentrically fitted within the tunnels. Fluid flow through the valves results through ports defined in the body of the tubular slide valves that are aligned with similar ports in their sleeve, that are in turn aligned with ports dynamically positioned above the compression or combustion region of the cylinder located below the head. Gas pressure develops shearing forces on valve sides. Gases are routed through the tubular interior of the sliding intake valve or valves during intake strokes, and exhaust gases are likewise forced out of the combustion cylinder through the interior of the exhaust valve or valves during exhaust strokes. Pressured gases traveling longitudinally through the valve interior passageways are inputted or outputted through lateral valve ports in fluid flow communication with the internal valve passageways.

Rather than pressuring faces of the valves in a direction normal to valve travel, exhaust and intake gas forces are directed against sides of the valves. To minimize potentially detrimental forces applied across the valves during, for example, the critical exhaust stroke, the valve body includes at least one reduced diameter portion forming a relief annulus within the valve chamber that distributes potential shearing pressure about the circumference of the valve. High pressure gas is confined between axially spaced apart sealing rings that prevent gases from flowing axially about the valve exterior.

All intake and exhaust gas flow is thus confined within the tubular interior of the valves. As a result, gas pressure does not develop a substantial resistive force upon leading surfaces of the valve in a direction coincident with the direction of valve travel. Instead gas pressure that might otherwise resist valve travel, and add to friction, is applied as a shear force, and pressure is evenly distributed in the relief annulus. Gas flow is distributed through the valve interior rather than around it, and friction is substantially reduced.

Importantly, the port sizes are maximized for efficient breathing. However, in the past, large sliding valve ports have contributed to inefficiency, reduced sealing, and premature valve failure. In the present design, the slide-valve sleeves are provided with a unique connecting bridge that traverses the port area, aligned with the direction of sliding valve travel. When the valves slidably reciprocate through this region, their sealing rings are supported tangentially by the bridges, to maintain ring integrity.

Thus a basic object of my invention is to provide a highly efficient aspiration or valve system for internal combustion engines, particularly four-cycle designs.

A related object is to provide an improved four cycle, internal combustion engine.

A related object is to improve combustion efficiency within an internal combustion engine. It is a feature of our invention that its advantageous overhead valve geometry and the reduction of valve-train parts needed for the invention increase overall efficiency.

Another important object is to preserve the sealing integrity of sliding valves. One important feature of the invention in this regard is that the head ports are provided with bridges that support the valve sealing rings during motion.

Another basic object is to provide a valve system for internal combustion engines that provides an enhanced power stroke. In other words, it is a feature of this invention that a higher proportion of the total 720 degrees of crankshaft rotation during typical four cycle operation occurs during the power stroke.

Another important object is to provide a sliding valve system of the character described that does not affect combustion chamber volume during operation. Important features of my invention are the fact that chamber expansion during valve displacement is avoided, and that the porting path does not consume the operational compression volume.

A related object is to provide a valve system of the character described wherein the valve structure does not enter the combustion chambers.

Another object is to provide a valve deflection system that applies force symmetrically, to minimize valve lash and allow higher engine speeds.

Yet another basic object is to minimize friction. It is a feature of my invention that spring-biased poppet valves and the typical frictional cam shafts and associate linkages such as rocker arms used to reciprocate poppet valves are avoided.

A still further object is to provide a valve system of the character described that is driven externally by a belt, so that efficiency is increased and complexity is reduced.

Another important object is to avoid so-called split-lift" applications used in the prior art for aspirating motors.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views:

FIG. 9 is a side elevational view of a preferred spool valve;

FIG. 10 is an end elevational view of the spool valve of FIG. 9, looking generally in the direction of arrows 10-10;

FIG. 10A is a longitudinal sectional view of a preferred spool valve, derived generally in the direction of arrows 10A-10A in FIG. 10;

DETAILED DESCRIPTION OF THE INVENTION

Figure 1:
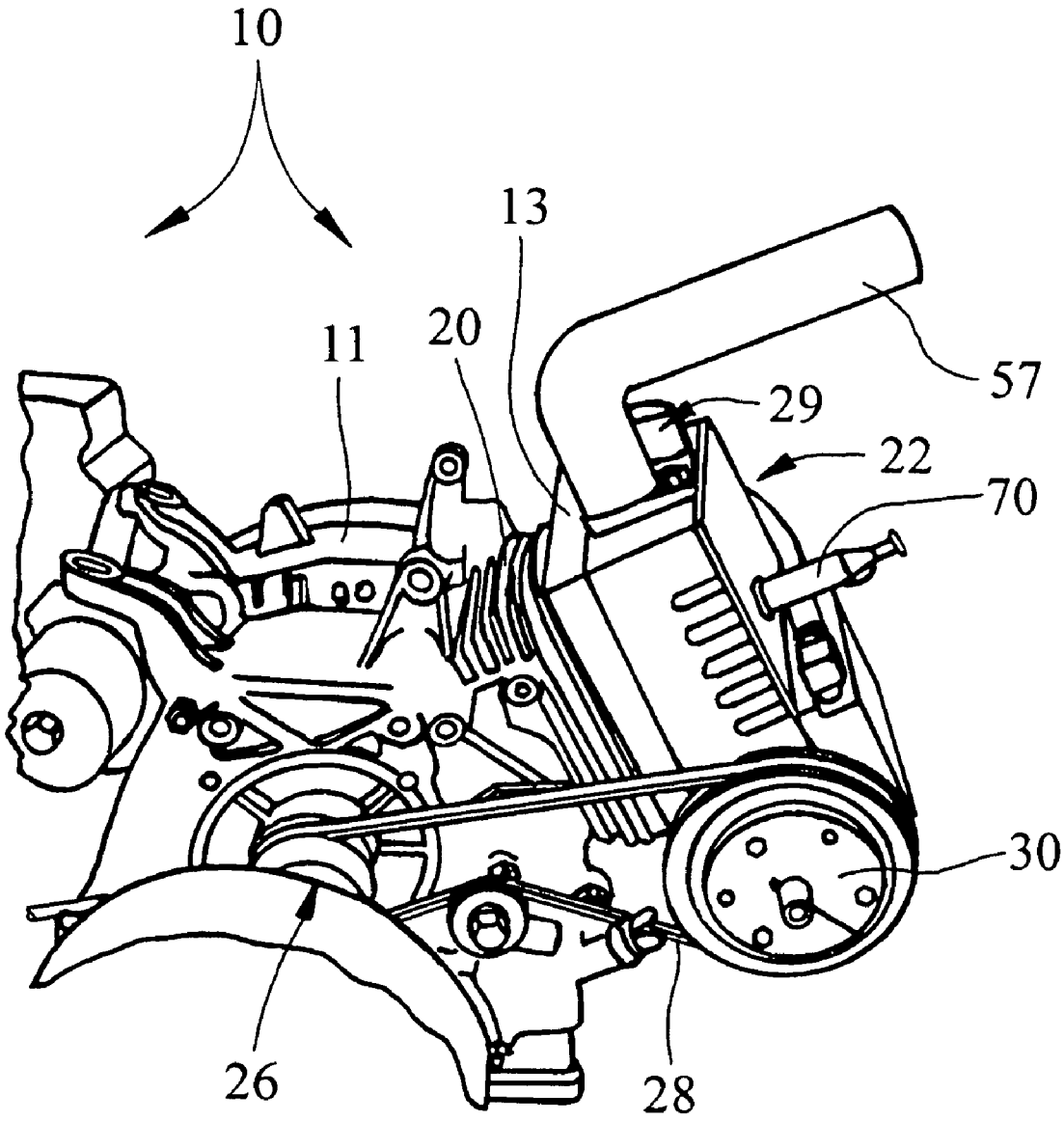
FIG. 1 is a fragmentary isometric view of a one-cylinder internal combustion engine constructed in accordance with the best mode of the invention known at this time.
Figure 2:
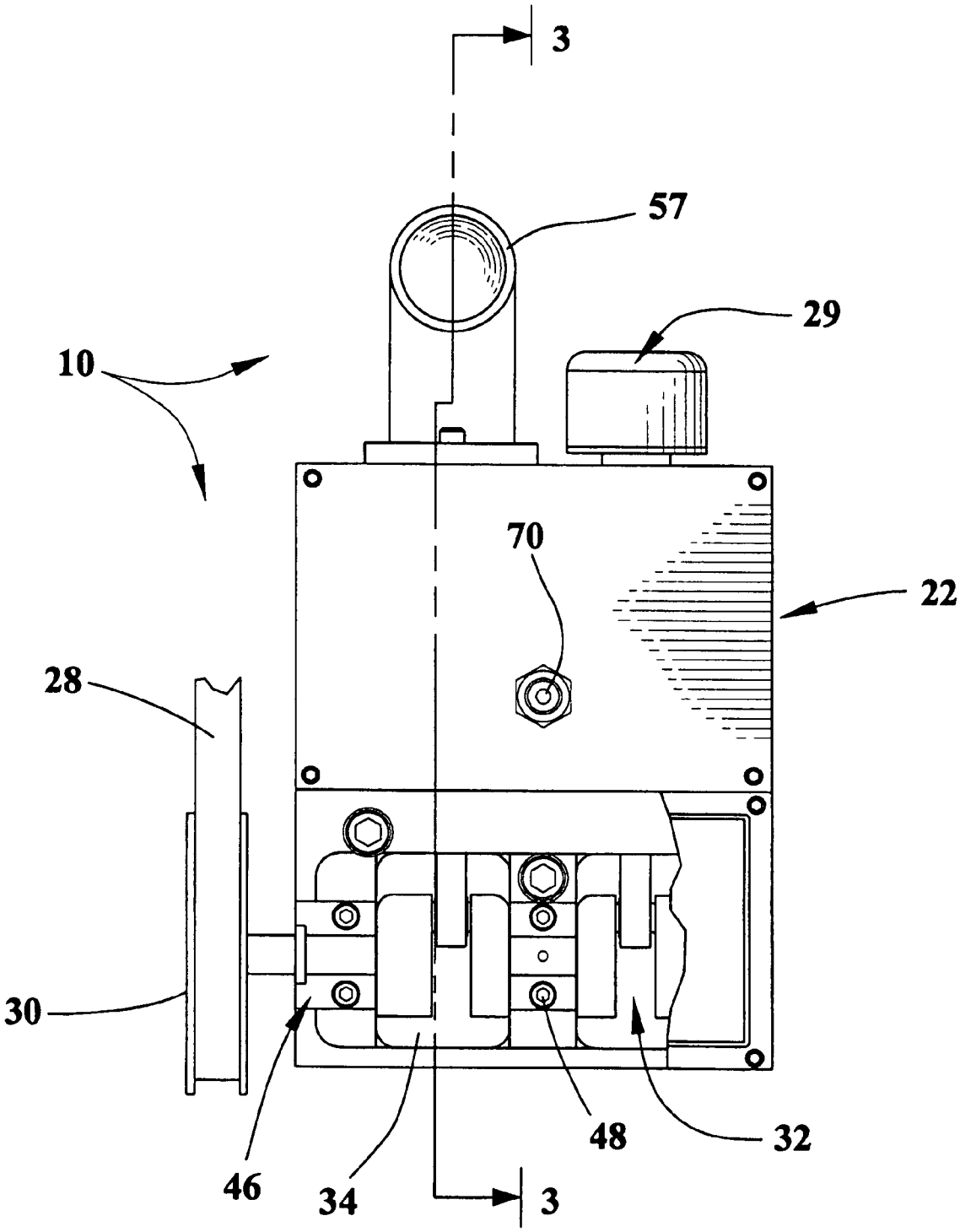
FIG. 2 is an enlarged, fragmentary, plan view of the engine taken generally from a position to the right of FIG. 1 and looking left, with portions thereof broken away or shown in section for clarity.

With initial reference directed to FIGS. 1-3, 3A, 4, 4A, and 5 of the appended drawings, a basic single-cylinder, four-cycle internal combustion engine equipped with the aspiration system constructed generally in accordance with the best mode of the invention has been generally designated by the reference numeral 10. It should be understood that the aspiration system as herein described is suitable for use with engines equipped with multiple cylinders, arrayed in the popular V-configuration or other configurations. The engine 10 has a rigid block 11 housing a primary crankshaft 12 (FIG. 3) of conventional construction that drives a reciprocating power piston 14 (FIG. 3) with a conventional connecting rod 16. The basic engine illustrated comprises a Honda thirteen-horsepower motor, which is modified as hereinafter described.

The standard combustion power piston 14 reciprocates within a cylinder 18 (FIG. 3) that is externally air-cooled with multiple external heat dissipation fins 20 (FIG. 1) proximate the engine deck 13. The basic construction of the conventional piston 14 and its accessories is substantially conventional and is not critical to practice of the invention. The instant sliding valve system is disposed within a head, generally indicated by the reference numeral 22 (i.e., FIGS. 4, 5, 7, 11), that mounts conventionally above the engine deck 13 above the conventional piston 14 and cylinder 18 described previously. The stroke of power piston 14 moves it upwardly and downwardly in a direction substantially perpendicular to head 11. For purposes of this invention, the term "head" shall generally designate that region of an internal combustion engine enclosing the combustion chambers, above the pistons. Such a head may be a conventional separate part bolted atop the engine, or in some cases the "head" may be integral with the engine block in a single casting that is thereafter appropriately machined.

Figure 4:
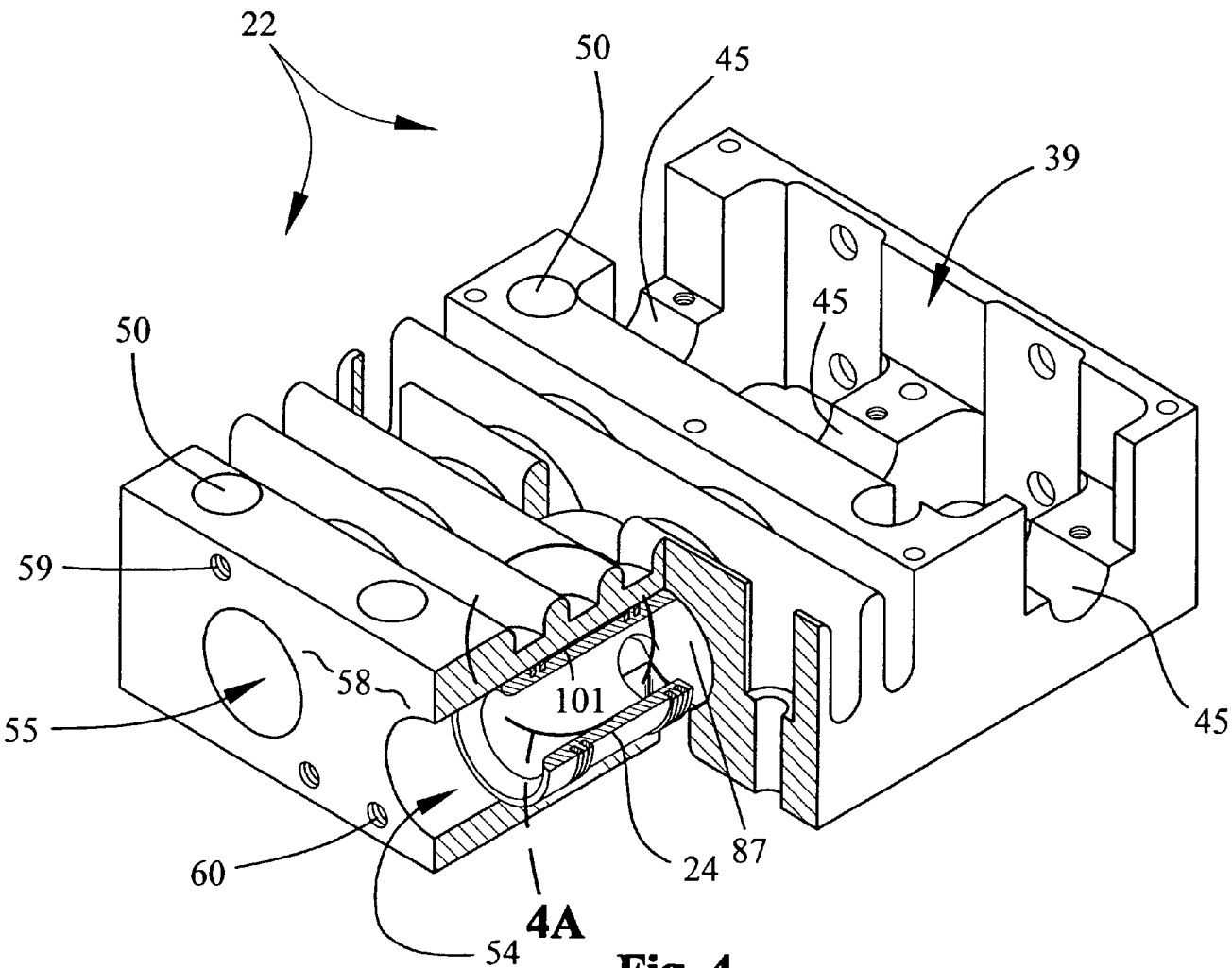
FIG. 4 is an enlarged, fragmentary, isometric view of the preferred cylinder head assembly, with portions thereof broken away or shown in section for clarity or omitted for brevity.
Figure 4A:
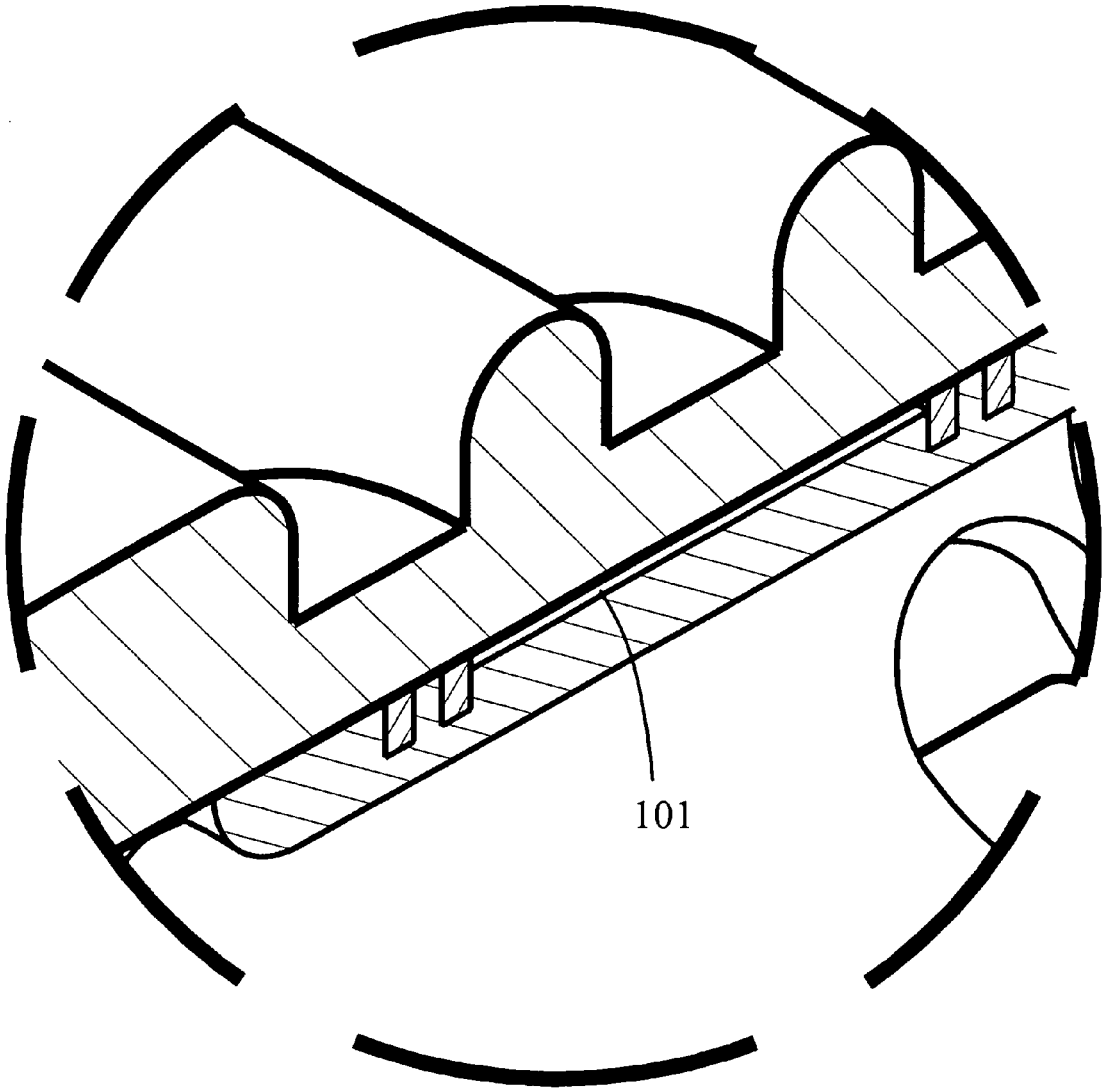
FIG. 4A is a greatly enlarged, fragmentary view of circled region 4A in FIG. 4.
Figure 5:
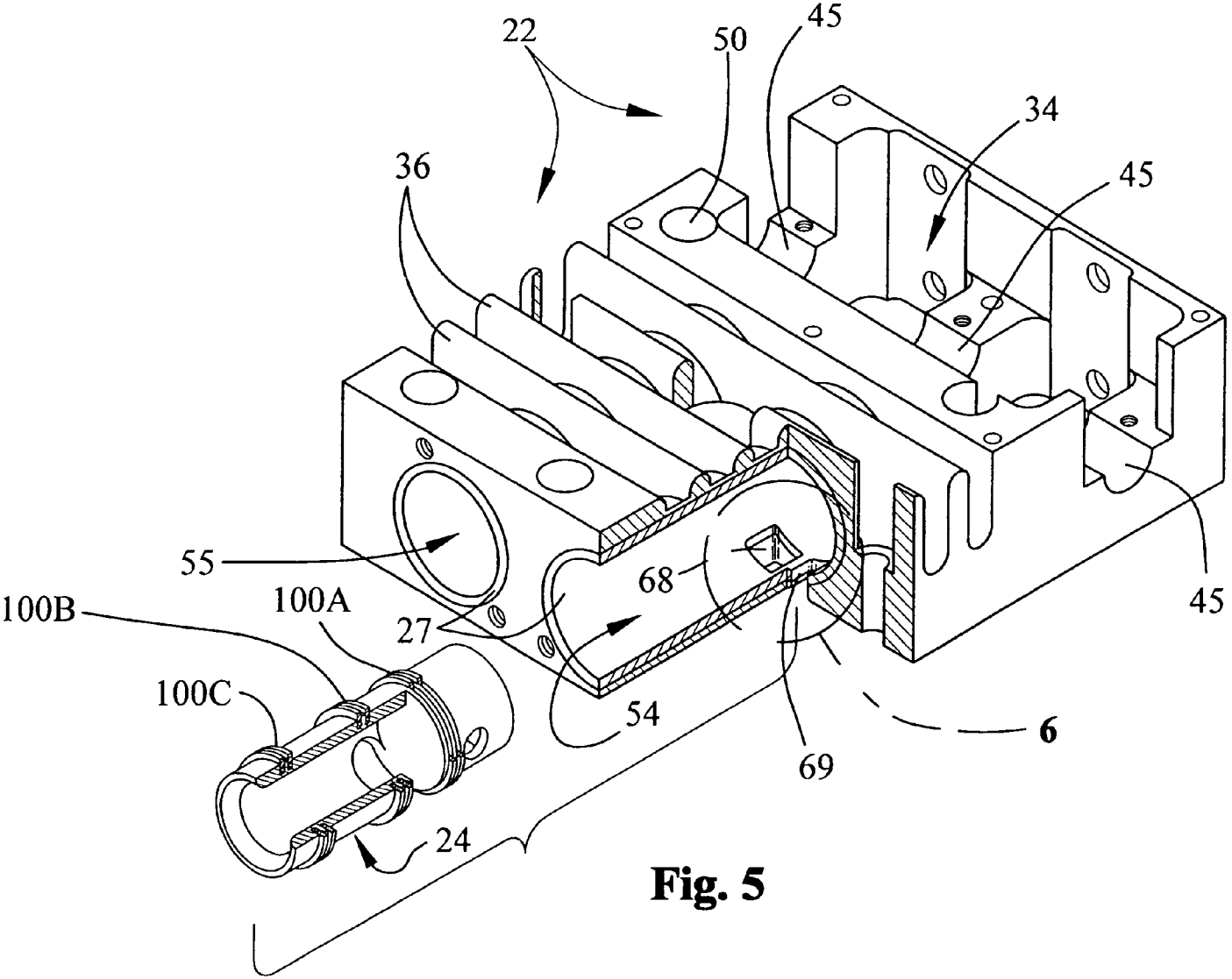
FIG. 5 is an enlarged, partially exploded fragmentary isometric view of the cylinder head assembly of FIG. 4, with a sliding valve removed from its sleeve, and with portions thereof broken away or shown in section for clarity.

With additional reference directed primarily now to FIGS. 4-11, head 22 houses a pair of tubular, sliding spool valves 24, 25 (FIGS. 8-10) that aspirate the cylinder 18. Based upon experiments so far, the tubular exhaust valve 24 and the tubular intake valve 25 are made from titanium in the best mode. While those skilled in the art will recognize that several alloys of titanium and/or titanium steel are available, my experiments have yet to reveal the ideal composition of these critical valves. Ordinary steel compositions however, result in heat damage and premature wear and failure. Furthermore, as illustrated in FIG. 5, for example, the sliding valves 24, 25 are mounted in appropriately ported sleeves 27 that fit into the cylinder head and line up with the sliding valve ports and appropriate ports in the head. However, experiments with the engine as depicted with sleeveless valves have shown the design to be rugged and dependable so far.

Figure 3:
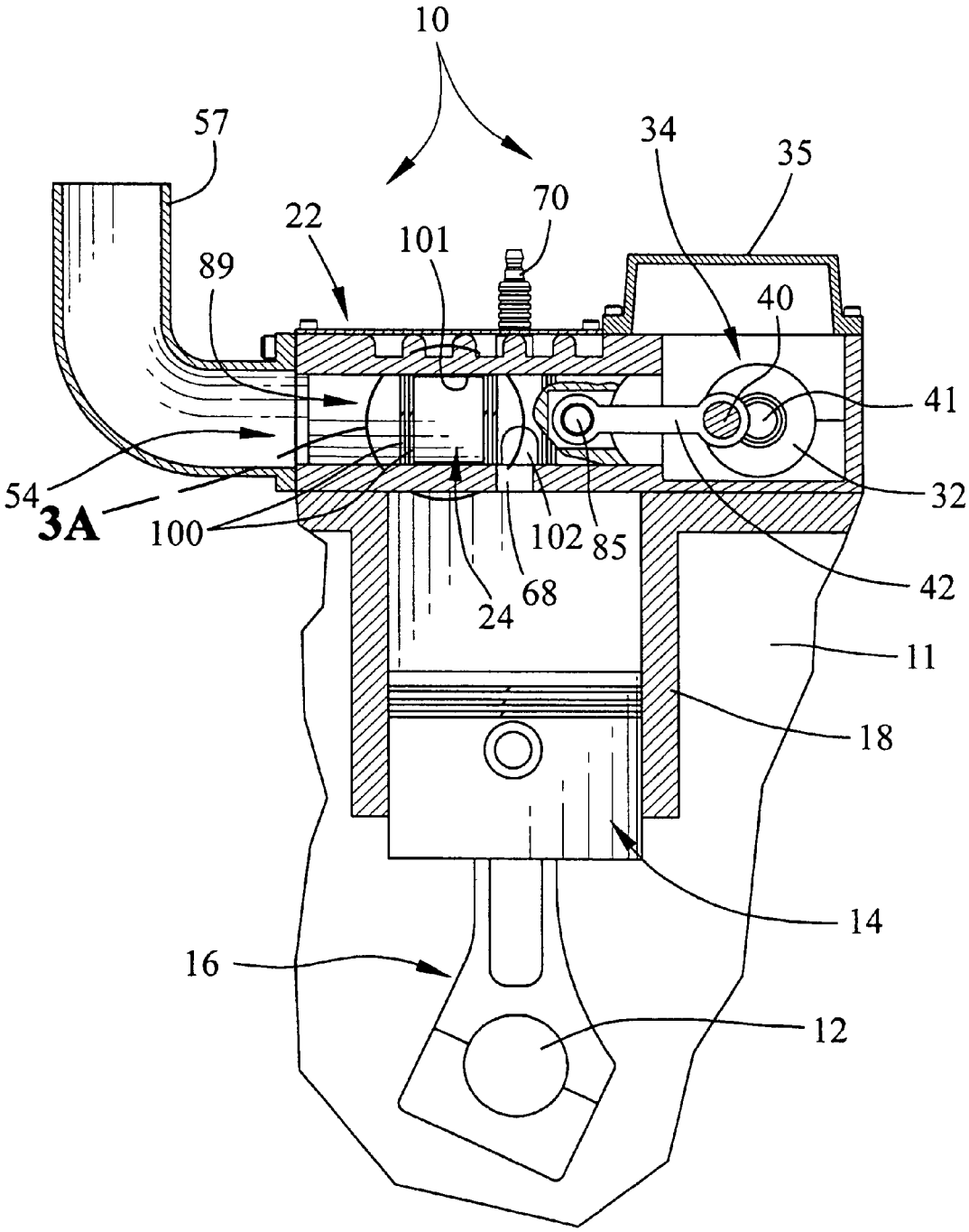
FIG. 3 is an enlarged, fragmentary sectional view taken generally along line 3-3 of FIG. 2.
Figure 3A:
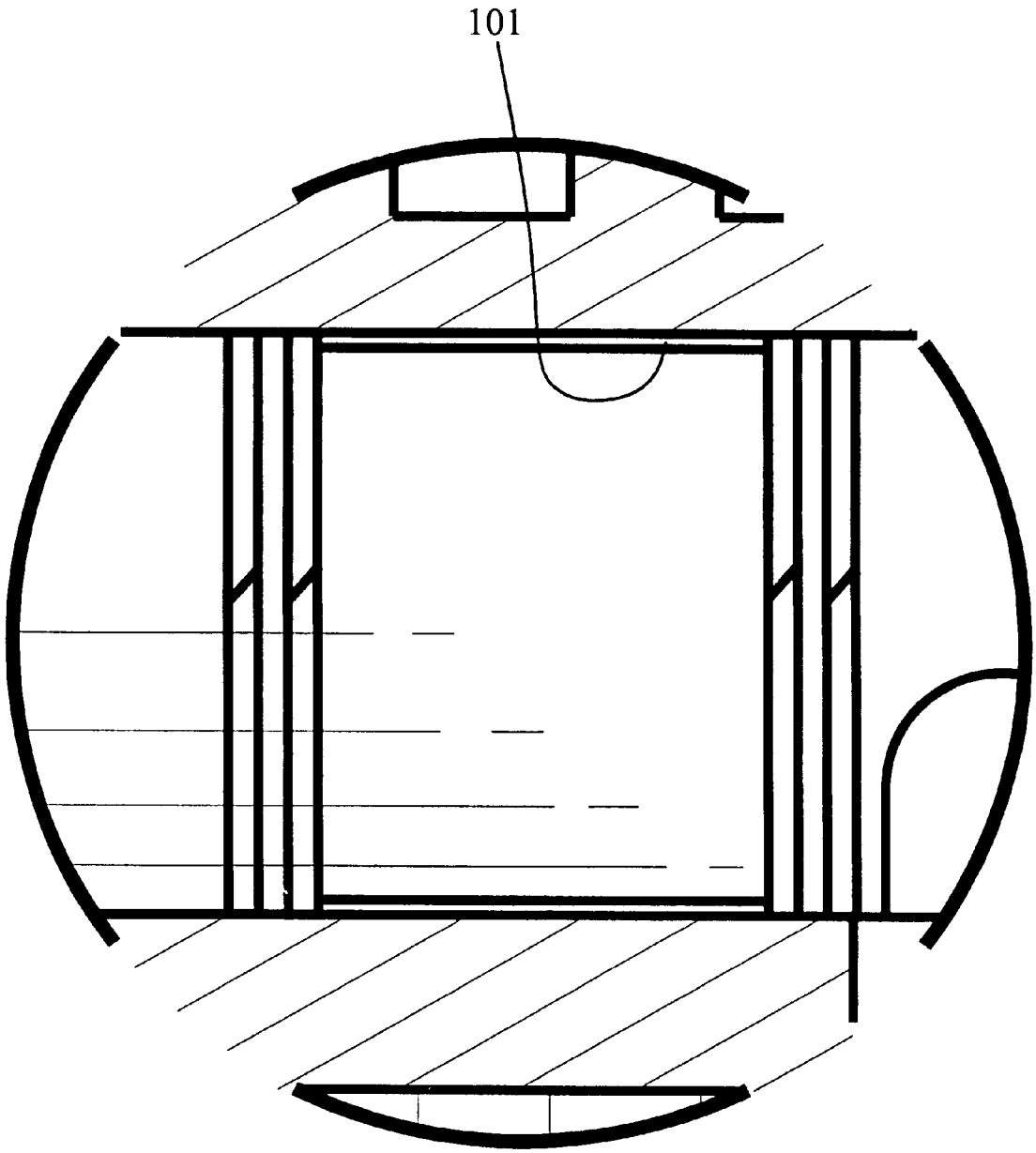
FIG. 3A is a greatly enlarged, fragmentary view of circled region 3A in FIG. 3.
Figure 25:
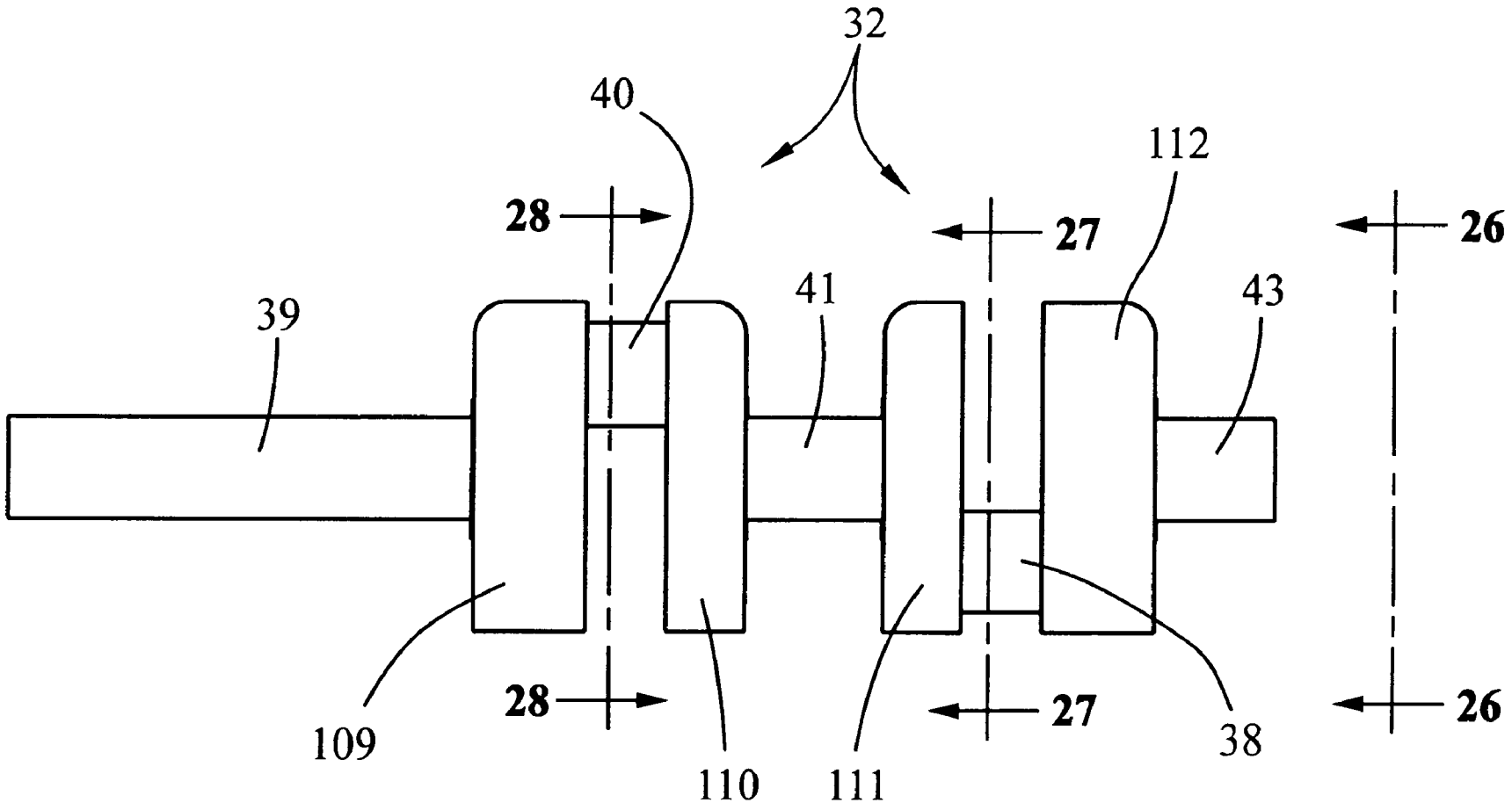
FIG. 25 is a longitudinal diagrammatic view of the preferred secondary crankshaft that operates the intake and exhaust spool valves and moves them between positions illustrated in FIGS. 13-24.
Figure 28:
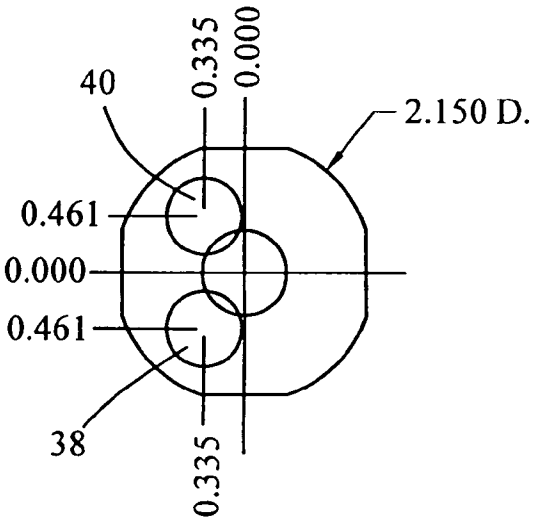
FIGS. 26-28 are sectional views taken respectively along lines 26-26, 27-27, and 28-28 of FIG. 25.
Figure 27:
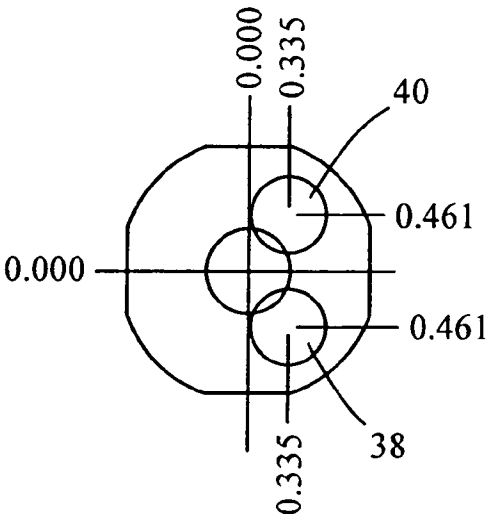
Figure 26:
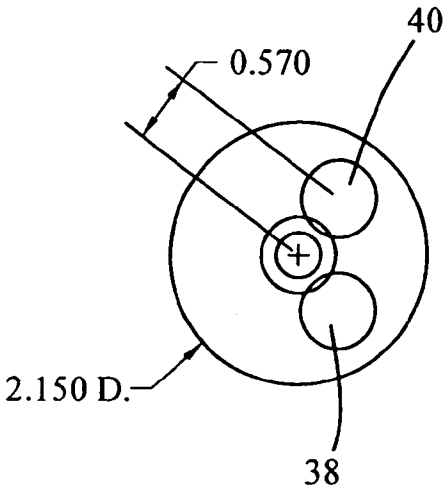

A drive pulley 26 (FIG. 1) driven by conventional internal crankshaft 12 (FIG. 3) is connected via drive belt 28 to a valve pulley 30 that drives the slide valve crankshaft 32 housed within head 22. Crankshaft 32, best seen in FIG. 25 discussed hereinafter, is mounted perpendicularly relative to sliding valves 24, 25 (i.e., FIGS. 7, 11). It extends across and through compartmentalized crankshaft mounting region 34 (FIG. 5) across the top (i.e., as viewed in FIGS. 4, 5) of the head 22. Region 34 contains liquid oil for lubricating the crankshaft and the slide valves to be described. Region 34 is normally covered by shroud 35 (FIG. 3). The crankshaft exhaust journal 38 and the crankshaft intake valve journal 40 (i.e., FIG. 25) of crankshaft 32 support connecting rods 42, 44 that respectively operate exhaust slide valve 24, and intake slide valve 25. Aligned and integral crankshaft portions 39, 41, 43 (i.e., FIG. 25) are rotatably constrained within conventional saddles 45 within mounting region 34 (i.e. FIG. 4, 5) and mounted with conventional bearing assemblies 46 (FIG. 2) as known in the art. In the best mode it is proposed that the counterweight sections 109, 110, 111, and 112 of the crankshaft (FIG. 25) be drilled appropriately for crankshaft balancing. Preferably the rotating and reciprocating aspiration slide valve assembly may thus be "balanced" and "tuned" for optimal aspiration performance.

Figure 7:
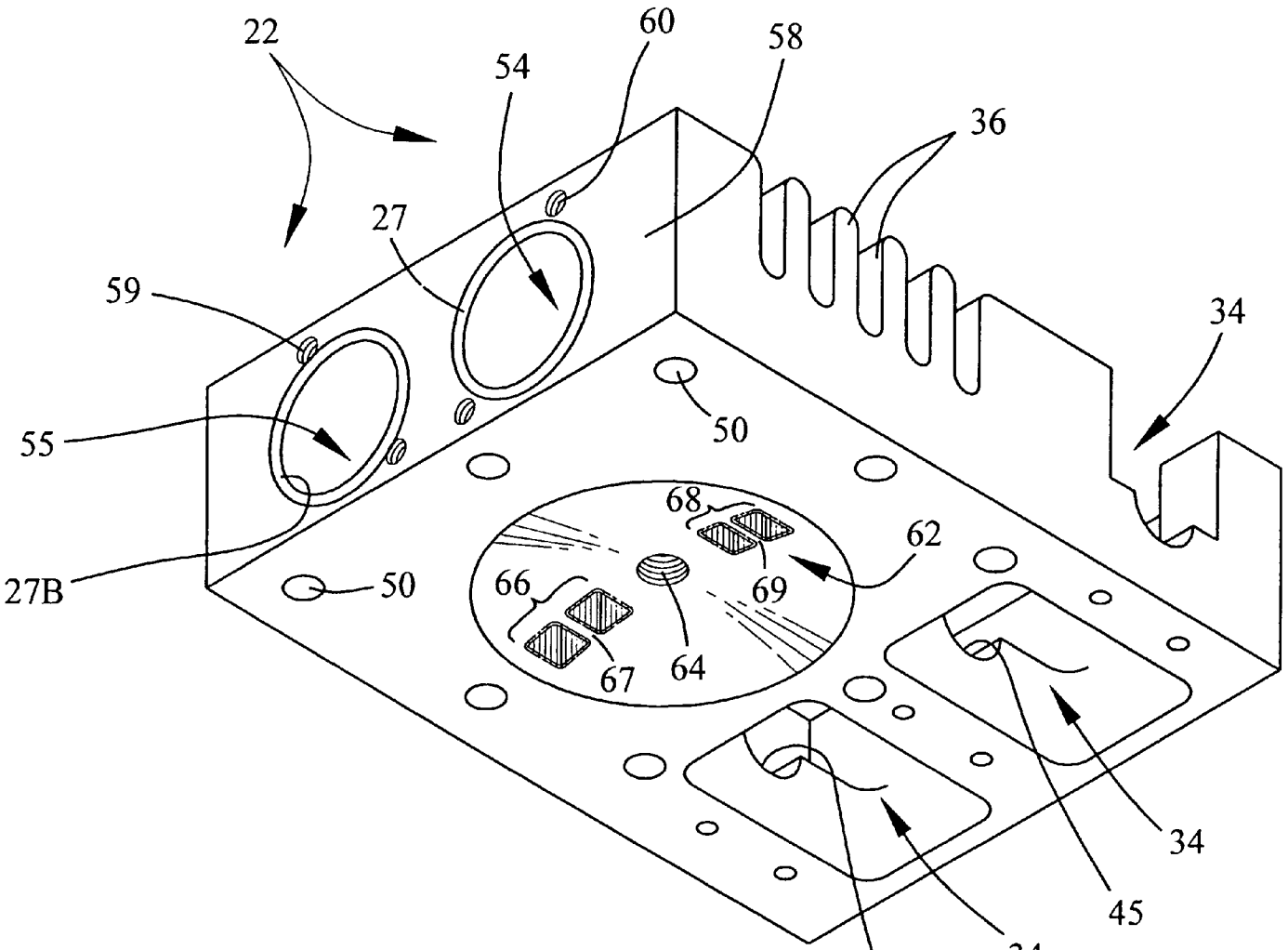
FIG. 7 is an enlarged bottom isometric view of the preferred cylinder head.

The crankshaft bearing assemblies 46 are bolted within crankshaft region 34 to mount the slide valve crankshaft 32 over the saddles 45 are secured with a plurality of bolts 48. As best seen in FIGS. 4,5 and 7, head 22 includes a plurality of spaced apart mounting orifices 50 through which head bolts 52 (FIG. 11) extend when mounting the head 22 to the deck 13.

The intake spool valve 25 (i.e., FIG. 11) is slidably received within a sleeve 27B disposed within head tunnel 55 (FIGS. 4, 11), that is spaced apart from and parallel with exhaust tunnel 54 and sleeve 27. Tunnels 54 and 55 are oriented generally perpendicularly to the stroke of the power piston 14. Exhaust spool valve 24 slidably reciprocates within sleeve 27 concentrically disposed within tunnel 54. Sleeves 27, 27B (FIGS. 5, 29-32) require ports aligned with head ports and valve described hereinafter, as appreciated by those skilled in the art. An air-fuel mixture is drawn into intake valve tunnel 55 from a conventional carburetor 29 (FIG. 2) mounted with screws received within orifices 59 (FIG. 4). Alternatively the invention may be used with fuel injection systems.

As best viewed in FIGS. 29-32, each sleeve 27 is elongated and tubular. Each has a pair of spaced apart open ends 31 defining opposite ends of an elongated cylindrical passageway in which the sliding valves 24 and/or 25 are inserted. A pair of ports 68A are separated by a bridge 69A (FIG. 29) that maintains pressure on the sliding valve rings during operation. While both sleeves are identical in dimensions and geometry, the exhaust sleeve should be of a more expensive heat resistant alloy. It is preferred that the exhaust sleeve be made of Steelite or Nickalloy heat resistant titanium steel alloy.

This invention requires maximal air flow quickly. In other words, it is preferred that the carburetor 29 have a relatively large throat with a relatively short venturi. In the model depicted in the drawings, which has been thoroughly tested, a Honda 350 cc. "dirt bike" motorcycle carburetor is preferred.

Figure 11:
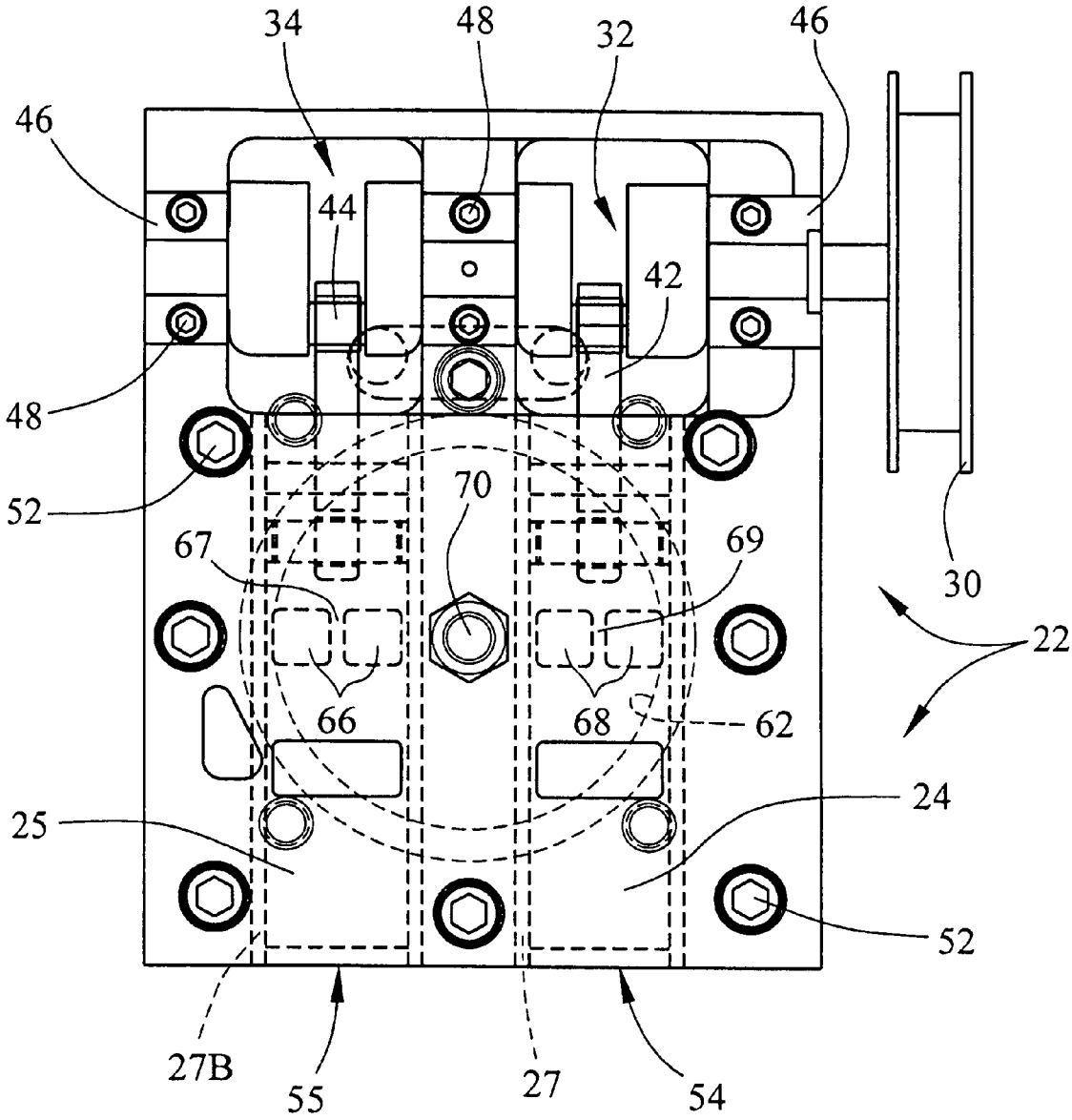
FIG. 11 is an enlarged top plan view of the preferred cylinder head, with phantom lines illustrating various internal parts, and with portions broken away or shown in section for clarity.

Exhaust valve 24 is slidably constrained within its sleeve 27 in tubular tunnel 54 (FIGS. 5, 7, 11). The exhaust header 57 (FIG. 1) is preferably screw-mounted upon the head's end surface 58 (FIGS. 4, 7) with suitable screws that penetrate orifices 60. Head cooling is encouraged by fin areas 36 (FIG. 5).

As best seen in FIG. 7, the circular combustion chamber 62 includes a central, threaded spark plug passageway 64 that is spaced between intake ports, collectively numbered 66, and exhaust ports, collectively numbered 68 (FIG. 7). A conventional spark plug 70 (i.e., FIGS. 1, 11) is threadably mated to passageway 64, with its electrodes positioned and centered within combustion chamber 62.

Figure 6:
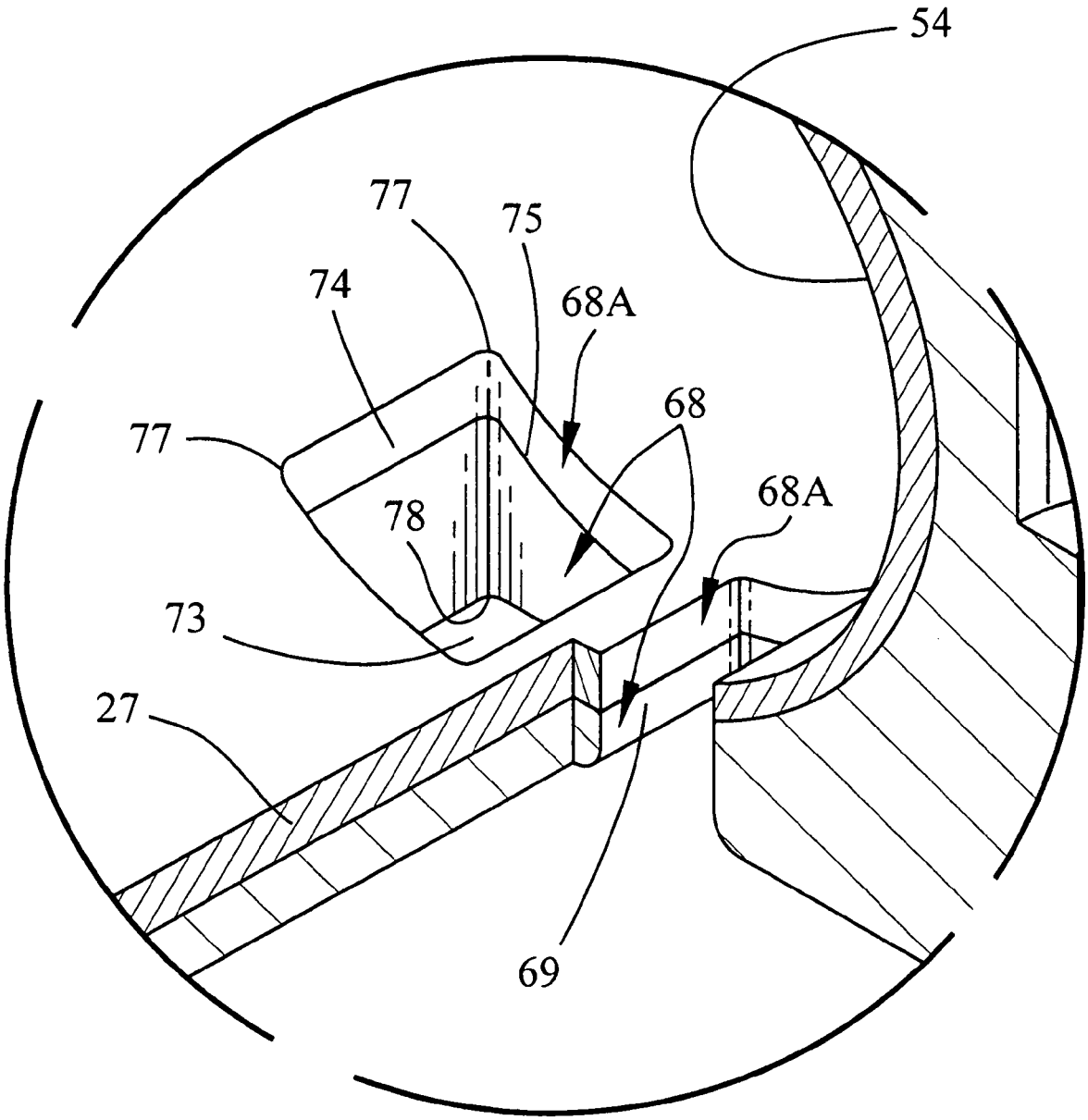
FIG. 6 is an enlarged, fragmentary isometric view taken generally from circled region "6" in FIG. 5.
Figure 29:
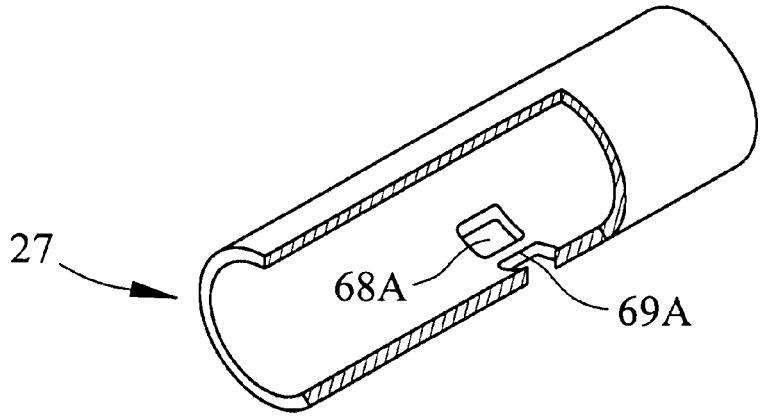
FIG. 29 is an isometric view of a preferred spool valve sleeve, with portions broken away for clarity.
Figure 30:
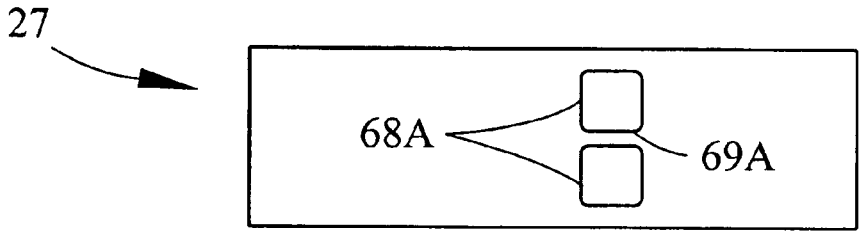
FIG. 30 is a bottom plan view of the sleeve of FIG. 29.
Figure 31:
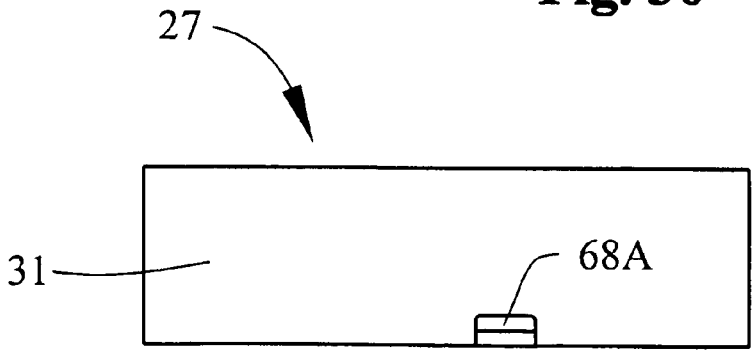
FIG. 31 is a side elevational view of the sleeve of FIG. 29.

As seen in FIGS. 29-30, for example, adjacent sleeve ports 68A are separated from one another by a central bridge 69A. Similarly intake ports 66 in the head (FIG. 7) built into the combustion chamber may be separated with a bridge 67 that is integral with the head 22. Similarly, a rigid, centered bridge 69 in the head separates the twin exhaust ports 68 (FIGS. 6, 7). These ports in the head must align with the valve sleeve ports 68A seen in FIGS. 29-32.

As best seen in FIG. 6, each head exhaust port 68 aligns with sleeve port 68A. The composite ports have smooth, downwardly inclined sidewalls 74, 75 that are polished for maximal fluid flow. These walls communicate with a lower orifice 73 in the head that opens to the combustion chamber 62. The intake ports 66 (i.e., FIG. 7) are similarly configured. Importantly, it is desired that corner ridges of the structure be radiused for maximum fluid flow, as illustrated by gently radiused corner regions Importantly, rigid, transverse bridges 69A are integrally formed in the sleeve port regions and bisect these regions into twin, side by side orifices 68A (FIG. 29). The head is similarly ported. In FIG. 7, for example, there are two pairs of ports 66 and 68 respectively separated by bridges 67, 69. Sleeve 69A bear against critical sealing rings associated with the sliding valves 24 and 25, as discussed below. By pressuring the sealing rings during valve travel, deformation of the critical sealing rings in the region of the various exhaust ports 68 and intake ports 66 is prevented. As sealing of the tubular slide valves 24, 25 is critical to the invention, bridges 67 and 69 are vital to the best mode of the invention.

With joint reference directed now primarily to FIGS. 8-12 and 10A, valves 24 and 25 are structurally virtually identical, so only exhaust valve 24 will be detailed. However, it is thought that the exhaust valve 24 requires a more heat resistance, so a premium grade of titanium alloy steel is preferred.

Figure 12:
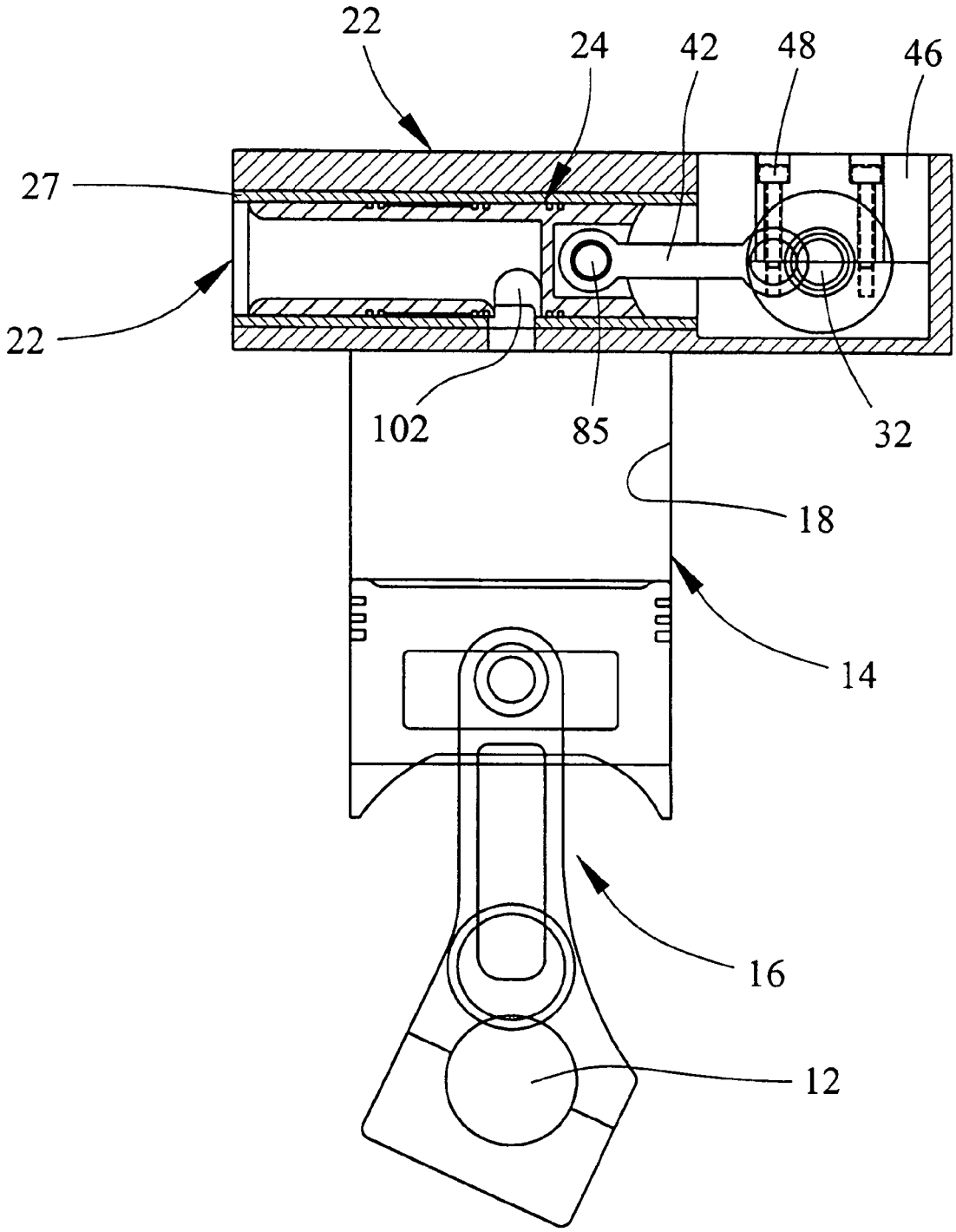
FIG. 12 is an enlarged, fragmentary diagrammatic view showing the basic arrangement of the engine power cylinder, the head, the overhead spool exhaust valve, and the exhaust valve sleeve.

Each valve 24, 25 is elongated, substantially tubular, and multi-sectioned. An open connecting rod section 80 enables connection to the connecting rod 42 (FIG. 12). The rod end 42 extends into the interior 82 of section 80 and is journalled by wrist pin 85 (FIG. 3) and is conventionally secured between wrist pin orifices 84 (FIGS. 9, 10A). Importantly, section 80 ends in a closed interior wall 87 that separates region 82 and the connecting rod structure from the rest of the tubular interior 89 (FIG. 10A) of the valve 24. The open end of the interior passageway 89 within each valve directly communicates through tubular tunnels 54, or 55 (FIG. 4) for aspiration fluid flow. The exterior of valve rod section 80 (FIGS. 9, 10A) is preferably cross hatched by machining to promote oil flow and distribution.

Figure 8:
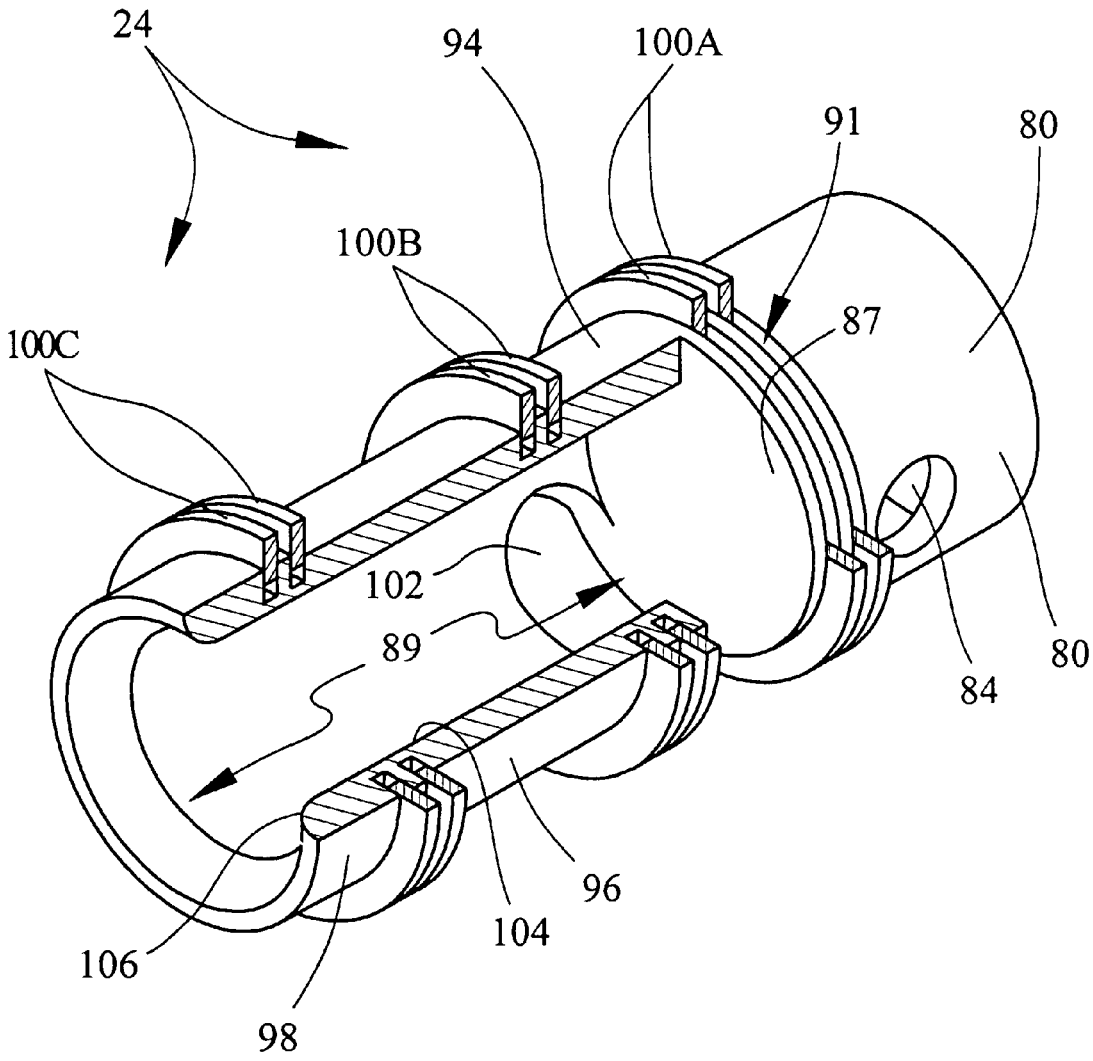
FIG. 8 is an enlarged isometric view of a preferred spool valve, with portions thereof broken away or shown in section for clarity.

In the best mode each valve has three pairs of external ring grooves to seat suitable sealing rings. For example, a pair of concentric and parallel ring grooves 91 separate valve rod section 80 from port section 94 (FIG. 9). Ring grooves 92 separate port section 94 from adjacent midsection 96. Similarly, ring grooves 93 separate midsection 96 from open section 98. FIG. 8 shows that each pair of ring grooves 91, 92 and/or 93 seats pairs of spaced apart, concentric sealing rings 100A, 100B and 100C respectively, that are externally, coaxially mounted about the valve exterior. Since each valve rod section 80 is in fluid flow communication with head region 34 that contains lubricating oil, rings 100A are oil rings. It will be recognized by those skilled in the art that when the valves 24 or 25 are fitted within their sleeves 27, (i.e., FIG. 4) the rings 100A, 100B, or 100C will seat within ring grooves 91, 92 or 93 (i.e., FIG. 9) and the exterior of the rings will be flush with the cylindrical outside body of the valves 24, 25, touching the interior surfaces of the captivating sleeves 27.

Figure 35:
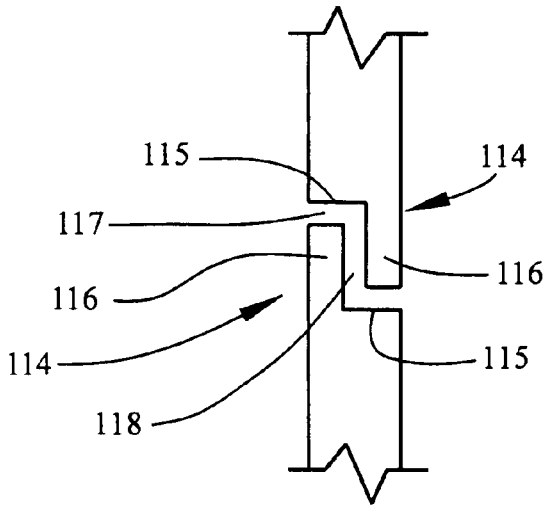
Figure 33:
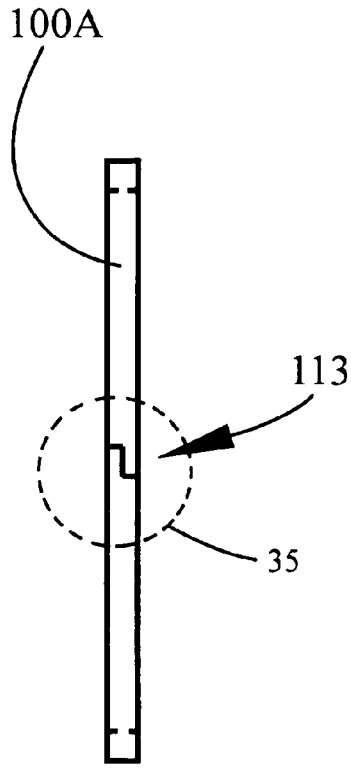
FIG. 33 is an enlarged, side elevational view of a preferred sealing ring used with the sliding valves.
Figure 34:
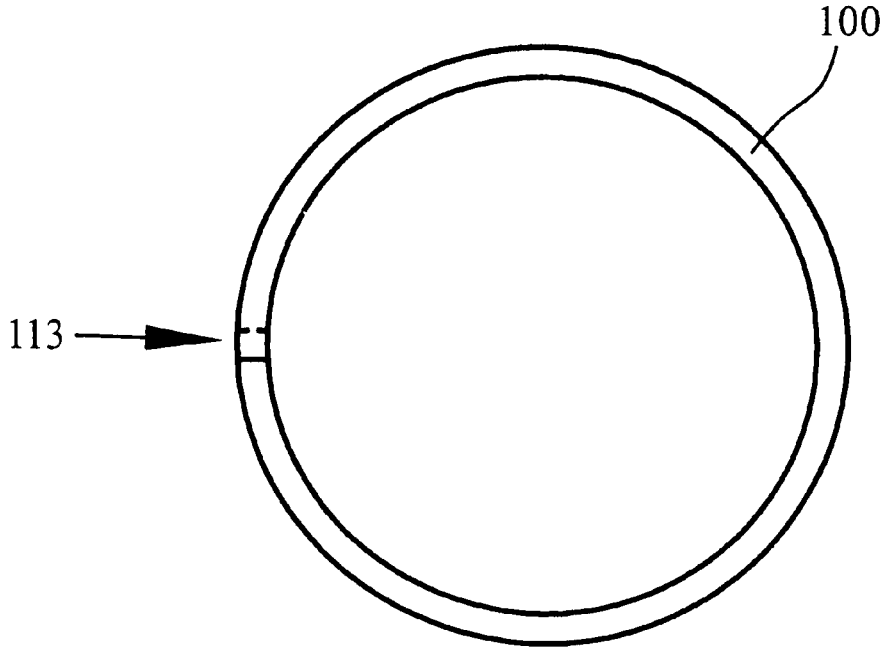
FIG. 34 is an enlarged, plan view of a preferred sealing ring used with the sliding valves; and, FIG. 35 is an enlarged, fragmentary plan view of circled region 35 in FIG. 33.

Each sealing ring 100A, 100B, 100C is preferably made of heat treated and heat resistant nickel alloy steel. As best seen in FIGS. 33-35, the compressively touching ends of the rings are stepped in the best mode to form an overlapped intersection 113 that forms an improved pressure seal. Preferably, each end of a given ring is configured in the overlapping or stepped configuration of FIG. 35, where abutting ring ends comprise a notched region 115 and a bordering, elongated tabbed region 116. The tabbed regions 116 are variably spaced apart from notched regions 115, with end gaps 117 therebetween. The parallel, spaced apart ring end gaps 117 allow for thermal expansion and contraction of the rings during operation. However, a sealing gap 118, which is perpendicular to gaps 117, is defined between mutually aligned and abutting tabbed regions 116. Gap 118 is much smaller than indicated, and provides a seal, as end regions 116 abut in operation, and seal the gaps for compression. At the same time gaps 117 allow for normal thermal expansion and contraction.

Importantly, the valve port section 94 (FIGS. 8, 9) includes an enlarged, arcuate cutout 102 functioning as an aspiration port (i.e., either exhaust or intake). Port 102 radially extends about approximately 30-40 percent of the radial periphery of the valve. A gently radiused arch 103 above port 102 (FIGS. 8, 10A) leads to the smoothly configured, generally cylindrical passageway 89 that leads to the exterior of the valve. Passageway 89 (FIG. 10A) comprises tubular interior passageway walls 104, terminating in gently radiused, flared lips 106 (FIG. 10A) at the valve end that maximize fluid flow. Aspiration occurs when valve ports 102 are aligned with sleeve ports 68A (FIG. 32) which are in turn aligned with head port pairs 66 or 68 (FIG. 7), in response to timed, reciprocal movements caused by the valve crankshaft 32 previously described. Thus when port 102 (FIGS. 3, 9) of the exhaust valve 24 overlies sleeve ports 68A (FIG. 32) and head ports 68 (FIG. 7), hot exhaust gases may be vented away from the combustion chamber 62 and lower cylinder 18 in response to upward movement of the power piston 14 towards top-dead-center. At this time exhaust gases are vented to the left (as viewed in FIG. 9) through port 102, along the valve interior passageway 89 (FIG. 8) and through head tunnel 54 (FIG. 7) and out header 57 (FIGS. 1, 3). Similarly, during the intake stroke, air and raw fuel is drawn through carburetor 29 into the head 22 through tunnel 55 (FIG. 7), and into the chamber 89 in the intake valve 25, through its port 102 and into the cylinder combustion region through head ports 66 (FIG. 7) and aligned sleeve ports 68A.

Figure 32:
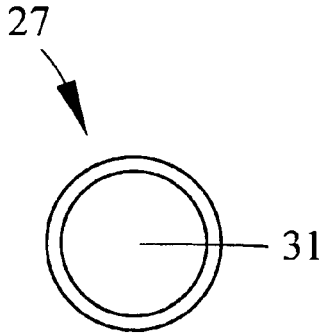
FIG. 32 is an end elevational view of the sleeve of FIG. 29.

Importantly, as slide valves 24, 25 reciprocate, their multiple sealing rings 100 are prevented from deformation while traversing sleeve ports 68A by the bridges 69A (i.e., FIG. 32). Further valve deformation is prevented by the downsized diameter of valve midsections 96 (i.e., FIG. 8). Referencing FIG. 9, the arrow 105 indicates the outside diameter of the majority of the length of valve 24. Sections 80, 94, and 98 are all of this relatively larger diameter. Valve midsection 96 however, has a reduced diameter indicated by the arrow 107 (FIG. 9). When the valves 24, 25 are positioned to "block" the various ports, midsection 96 is positioned over them. Thus a cylindrical or annular region 101 (FIGS. 3, 3A, 4 and 4A) defined radially around the external periphery of valve midsection 96 between the surrounding tunnels 54 or 55, and axially defined between the rings 100 on opposite ends of valve midsection 96, will be in fluid flow communication with the combustion chamber 62. Annulus 101 thus distributes potential shearing pressure about the circumference of the valve when the ports are blocked during various valve stroke positions to reduce damage. During the power stroke, for example, the shock from rising gas pressure will be uniformly distributed about the radial periphery of valve midsection 96 within annulus 101, equalizing forces that might otherwise deform the valve.

OPERATION

Figure 13:
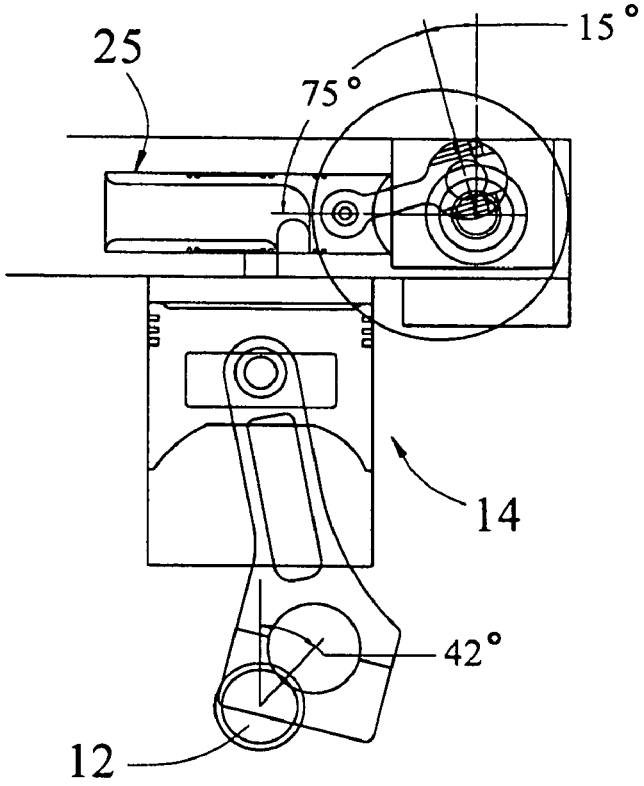
FIGS. 13-15 are diagrammatic views of progressive intake spool valve movements during the intake stroke as the power crankshaft rotates.
Figure 14:
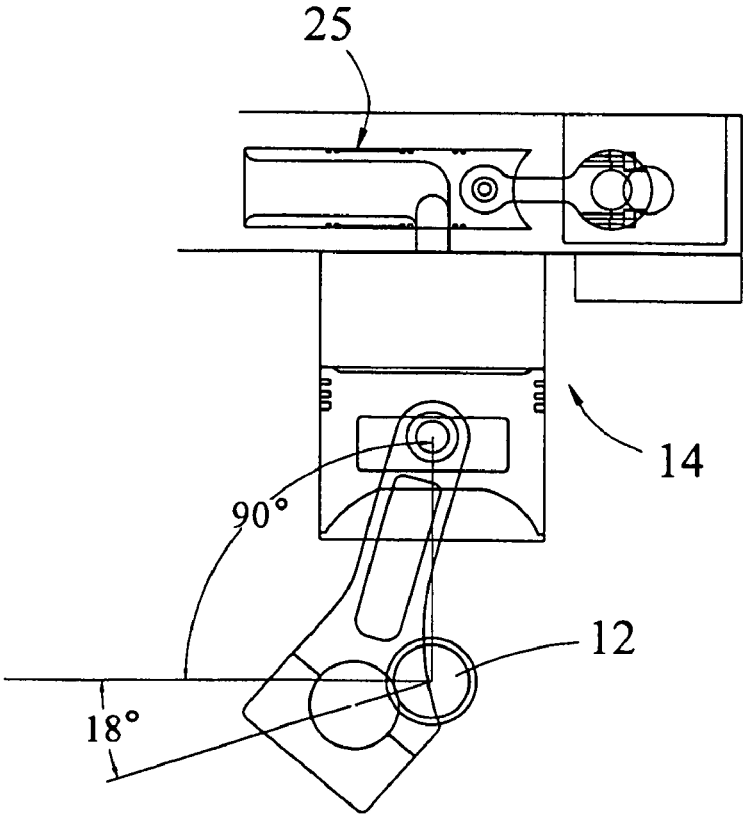

In FIG. 13 intake valve 25 has started to open at the beginning of the intake stroke. In FIG. 14 the intake valve 25 is now open at approximately 108 degrees BTDC.

Figure 15:
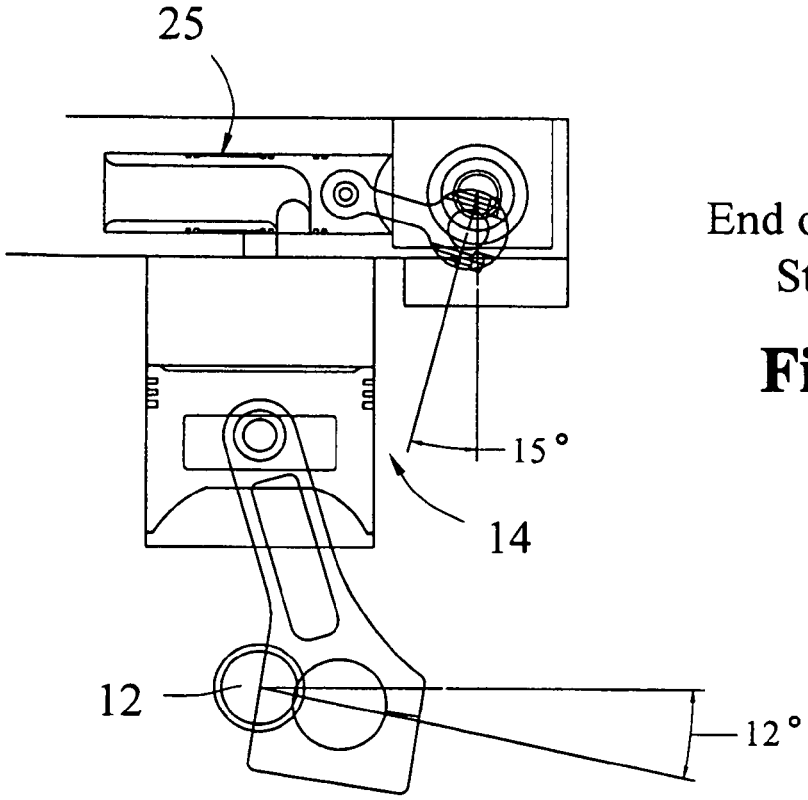
Figure 16:
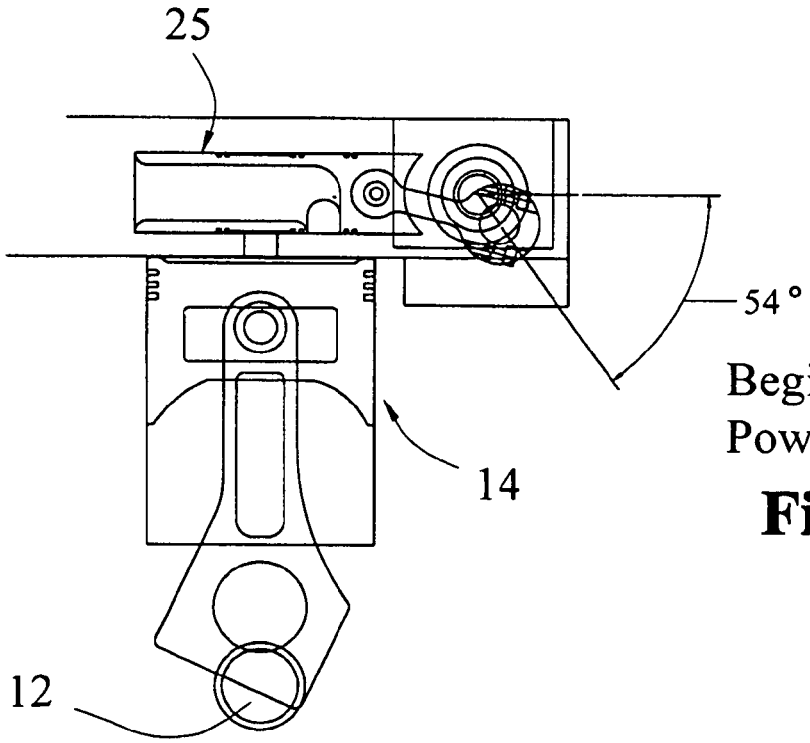
FIG. 16 is a diagrammatic view showing the intake spool valve position when the spark plug fires at the beginning of the power stroke.

FIG. 15 shows the intake valve 25 closing at the end of the intake stroke. Full closure of valve 25 is indicated in FIG. 16 at the beginning of the power stroke.

Figure 17:
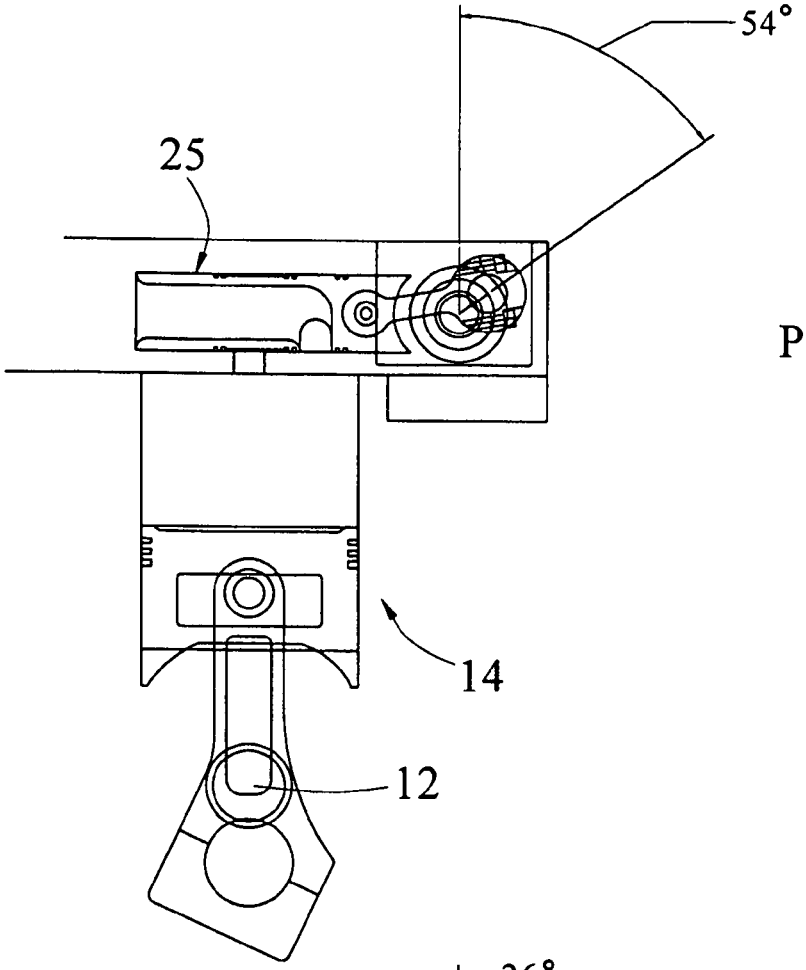
FIG. 17 is a diagrammatic view showing the intake spool valve position at the bottom of the power stroke.
Figure 18:
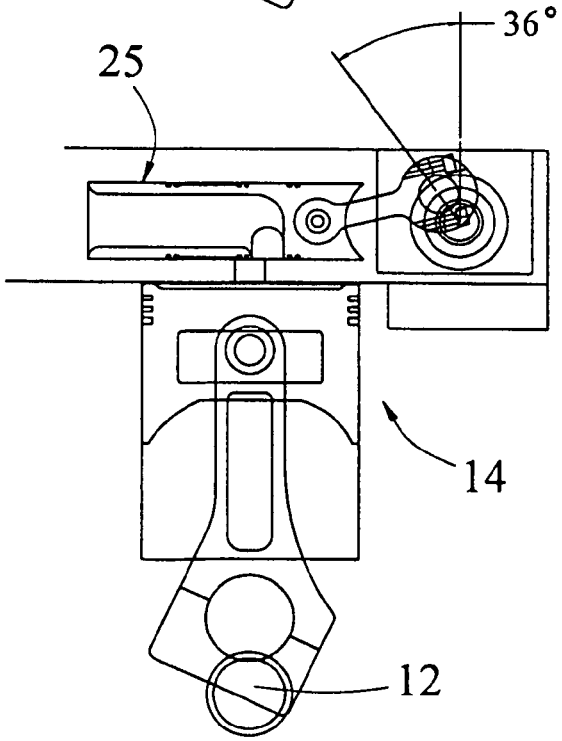
FIG. 18 is a diagrammatic view showing the intake spool valve position at the end of the exhaust stroke.

FIG. 17 shows the bottom of the power stroke, with the intake valve 25 fully closed. In FIG. 18 at the end of the exhaust stroke the intake valve 25 is seen starting to open.

Figure 19:
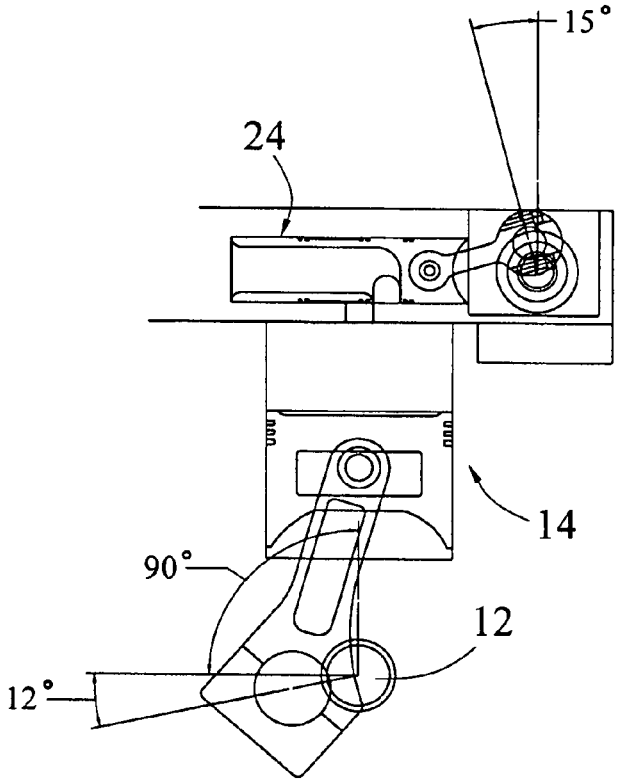
FIG. 19 is a diagrammatic view showing the exhaust spool valve position at the start of the exhaust stroke.
Figure 20:
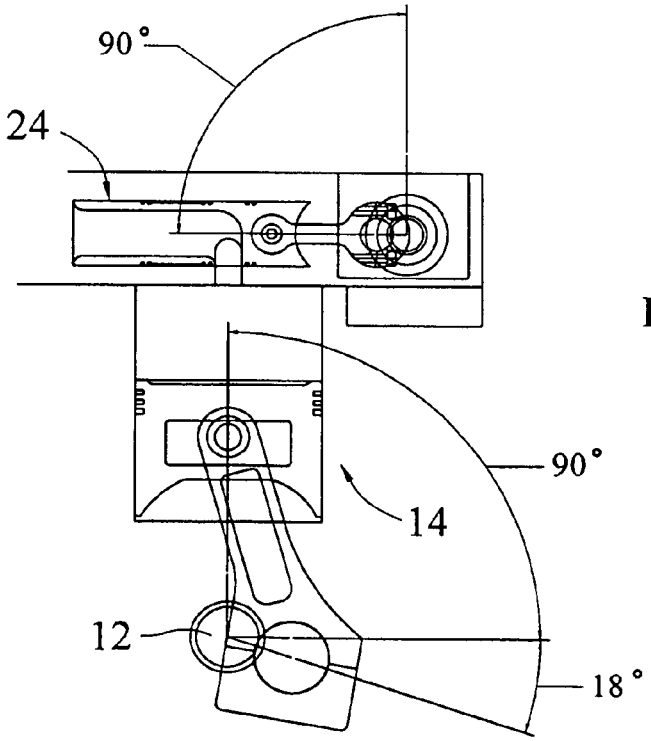
FIG. 20 is a diagrammatic view showing the fully open exhaust spool valve position at 251 degrees of engine crankshaft angle.

The exhaust valve 24 is seen in FIG. 19 at the start of the exhaust stroke. In FIG. 19, the plug and cylinder have fired, and at 108 degrees ATDC the exhaust valve 24 starts to open. In FIG. 20 the exhaust valve 24 is completely open, with 251 degrees crankshaft angle.

Figure 21:
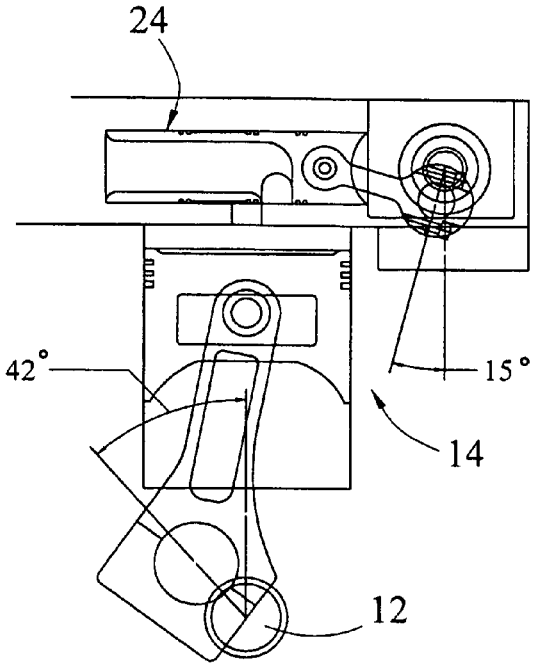
FIG. 21 is a diagrammatic view showing the closing exhaust valve at the beginning of the intake stroke at 222 degrees of crankshaft angle.
Figure 22:
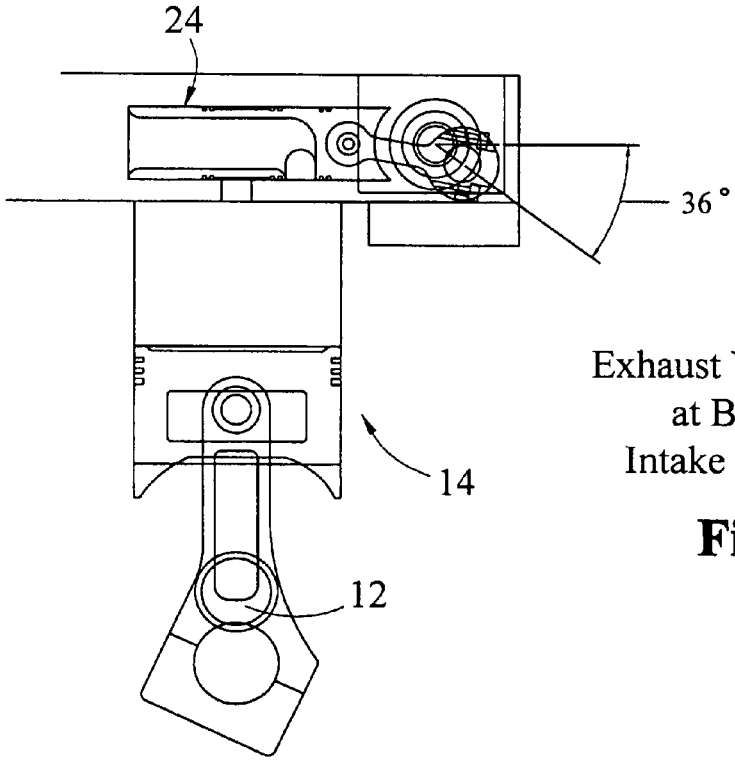
FIG. 22 is a diagrammatic view showing the fully closed exhaust valve at the bottom of the intake stroke at 180 degrees of crankshaft angle.

At the beginning of the intake stroke in FIG. 21 the exhaust valve 24 begins to close, at approximately 222 degrees. The bottom of the intake stroke is seen in FIG. 22, at which time the exhaust valve 24 is fully "closed," and the reduced diameter midsection 96 is positioned over the exhaust ports 68.

Figure 23:
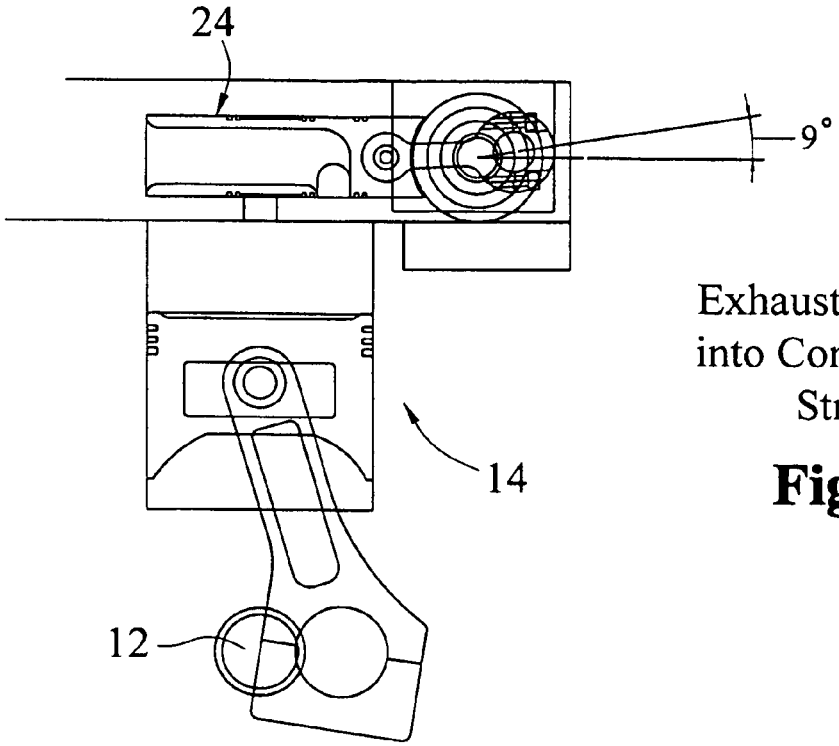
FIG. 23 is a diagrammatic view showing the closed exhaust valve 90 degrees into the compression stroke.
Figure 24:
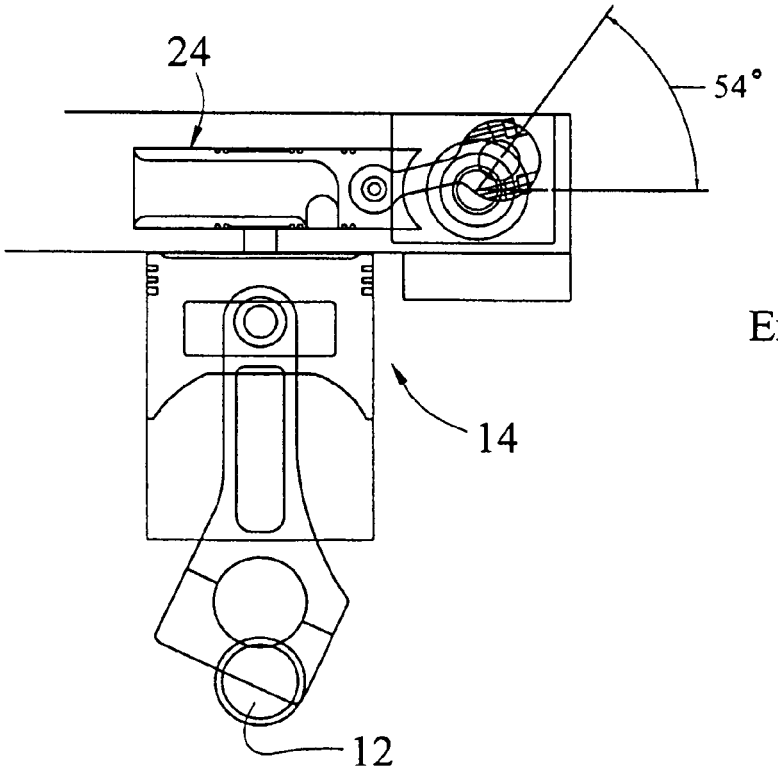
FIG. 24 is a diagrammatic view showing the closed exhaust valve at zero degrees TDC.

In FIG. 23 the exhaust valve 24 is completely open, 90 degrees into the compression stroke. In the positions of FIG. 24 the plug fires, and the exhaust valve 24 is completely closed at zero degrees TDC.

In FIGS. 25-28 the configuration and position of the crankshaft 32 is illustrated. The exhaust valve journal 40 and the intake journal 38 are seen in critical rotational positions.

EXAMPLE

Dyno Test Chart—December, 2008

| LOW LOAD | FACTORY ENGINE | G1 ENGINE |
|---|---|---|
| Load % | 33% | 33% |
| RPM | 2900 | 2900 |
| Run Time | 1:30 minutes | 1:30 minutes |
| lb-ft Torque | 7.5 | 7.5 |
| Brake Horsepower | 4.1 | 4.1 |
| Fuel Usage - Milliliters | 12.07 | 10.86 |
| Nitrogen Oxide—NOX | 10.97 | 10.97 |
| Carbon Monoxide—CO | 0.95 | 1.07 |
| Hydrocarbons—HC | 21.9 | 2.39 |
| Carbon Dioxide—CO2 | 2.1 | 2 |
| Oxygen—O2 | 1.41 | 1.43 |

G1 Fuel Usage Results Per Unit of Brake Horsepower

Low Load Fuel Usage: 10% Less than Factory Engine (12.07−10.86=1.21/12.07)

| HIGH LOAD | FACTORY ENGINE | G1 ENGINE |
|---|---|---|
| Load % | 80% | 80% |
| RPM | 3550 | 3550 |
| Run Time | 1:30 minutes | 1:30 minutes |
| lb-ft Torque | 10 | 14 |
| Brake Horsepower | 6.7 | 9.4 |
| Fuel Usage - Milliliters | 13.19 | 8.65 |
| Nitrogen Oxide—NOX | 5.97 | 4.57 |
| Carbon Monoxide—CO | 0.58 | 0.44 |
| Hydrocarbons—HC | 11.04 | 1.07 |
| Carbon Dioxide—CO2 | 1.29 | 0.8 |
| Oxygen—O2 | 1.34 | 0.67 |

G1 Fuel Usage Results Per Unit of Brake Horsepower

High Load Fuel Usage: 34.4% Less than Factory Engine (13.19−8.65=4.54/13.19)

G1 High Load Emission Results Per Unit of Brake Horsepower

NOX: 23.4% Less than Factory Engine HC: 90.3% Less than Factory Engine

CO: 24.1% Less than Factory Engine CO2: 37.9% Less than Factory Engine

Two GX 390 Honda 13 hp engines were used for testing and comparisons (i.e., a "stock" engine versus one modified in accordance with the instant invention). Both engine specifications were as follows:

Four stroke valve single cylinder
3.5×2.5 bore & stroke
4.412 rod length
Forced air cooling systems
Gravity feed fuel systems
87 octane gasoline
23.7 cu/in displacement
Transistorized magnet ignition systems The muffler was removed on both engines to confine exhaust emissions for analysis purposes. The engine with the stock head is named the "Factory" engine on the above chart. The engine with our proprietary head is named the "G1" on the above chart.

All tests were conducted on the same day in a controlled and isolated environment. Fuel and emission measurements were made using the following equipment:

Land & Sea Water Brake Dyno, the Dyno-Max 2000 Model
Dyno-Max 2000 Data Analysis Software and Multimedia PC Demonstration, 9.38 SPI Version
UEI AGA 5000 Emissions Analyzer
ASTME rated ⅜ inch Bellwether 100 cc Tube The primary objective of house testing was to determine the fuel usage of the modified engine. We kept run time, load and rpm constant. To compare and measure the efficiency, input was divided by output. In our particular case, fuel usage was our input variable and our output variable was the pound-foot of torque produced. Fuel usage and all emissions results of both engines were calculated based on a unit of brake horsepower (torque×rpm/5252).

The low load fuel usage per unit of brake horsepower for the G1 engine was 10% less than the Factory engine. The high load fuel usage per unit of brake horsepower for the G1 engine above. It was determined that fuel consumption of the modified engine G1 was 34.4% less than the Factory engine. The high load emissions per unit of brake horsepower for the G1 engine resulted in 23.4% less nitrogen oxide (NOX), 24.1% less carbon monoxide (CO), 90.3% less hydrocarbons (HC) and 37.9% less carbon dioxide (CO2) compared to the Factory engine.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

What is claimed is:

1. An improved head adapted to be secured to an internal combustion engine of the type comprising a rigid block, a primary crankshaft rotatably disposed within said block, at least one cylinder defined in said block, at least one power piston driven by said crankshaft and reciprocated within said at least one cylinder, the head comprising:

means for attaching said head to said block over said at least one piston;

at least one pair of exhaust ports formed in said head adapted to be disposed proximate said piston;

at least one pair of intake ports formed in said head adapted to be disposed proximate said piston;

an elongated, tubular exhaust tunnel disposed in said head proximate said head exhaust ports, said exhaust tunnel adapted to be oriented transversely with respect to said cylinder;

an elongated, tubular intake tunnel disposed in said head proximate said head intake ports, said intake tunnel adapted to be oriented transversely with respect to said cylinder;

a tubular, sliding exhaust valve disposed within said cylindrical exhaust tunnel in said head, said exhaust valve comprising an exhaust gas port and an elongated internal tubular passageway in fluid flow communication with said valve exhaust gas port for exhausting gases and a plurality of coaxially mounted, spaced apart, external sealing rings;

a tubular, sliding intake valve disposed within said intake tunnel in said head, said intake valve comprising an intake gas port and an elongated, internal tubular passageway in fluid flow communication with said valve intake gas port for intaking a raw fuel/air mixture and a plurality of coaxially mounted, spaced apart, external sealing rings;

a slide valve crankshaft rotatably mounted within said head for reciprocating said sliding exhaust and intake valves in response to rotation of said primary crankshaft, such that the exhaust valve gas port is aligned with the exhaust ports in said head during an exhaust stroke of said piston and otherwise said exhaust valve closes said head exhaust ports, and such that the intake valve gas port is aligned with the intake ports in said head during an intake stroke of said piston and otherwise said intake valve closes said head intake ports;

wherein said slide valve crankshaft has an axis of rotation oriented generally perpendicularly with respect to said slide valves;

valve connecting rods mechanically connecting said slide valve crankshaft with said sliding intake and sliding exhaust valves; and, wherein the ports forming said at least one pair of exhaust ports in said head are separated from one another by bridges that contact rings on said exhaust valve, and the ports forming said at least one pair of intake ports in said head are separated from one another by bridges that contact rings on said intake valve.

2. The head as defined in claim 1 further comprising a relief annulus defined between a reduced diameter region of each valve and the passageway in which the valve is slidably disposed to distribute shearing pressures about the circumference of the valve.

3. The head as defined in claim 2 wherein said primary crankshaft drives an external drive pulley, said slide valve crankshaft has an axis of rotation parallel with and spaced apart from said primary crankshaft axis of rotation, said slide valve crankshaft has a second pulley, and a belt is entrained about said drive and said second pulleys.

4. The head as defined in claim 3 wherein each of said intake and exhaust ports defined in said head comprises smooth, inclined sidewalls that are polished for maximal fluid flow.

5. The head as defined in claim 1 wherein each exhaust and each intake valve comprises an open connecting rod section enabling connection to the valve's connecting rod, and a closed wall that separates the connecting rod section from the valve internal tubular passageway.

6. The head as defined in claim 5 wherein each exhaust and intake valve comprises a port section proximate said closed wall in which the valve ports are defined, an adjacent midsection, and an open section in fluid flow communication with said valve ports.

7. The head as defined in claim 6 wherein each valve port section comprises an arcuate cutout functioning as an aspiration port that radially extends between 30-40 percent around the radial periphery of the valve.

8. The head as defined in claim 6 wherein concentric ring grooves separate each valve rod section from the port section, concentric ring grooves separate each valve port section from the adjacent midsection, and concentric ring grooves separate the valve midsection from the valve open section.

9. The head as defined in claim 8 wherein said sealing rings are coaxially, externally mounted to said valves and seated within said concentric ring grooves.

10. The head as defined in claim 9 wherein the sealing rings are stepped for enhanced compression and comprise:

abutting ring ends with a notched region and a bordering tabbed region;

the tabbed regions variably spaced apart from said notched regions;

end gaps between the notched and tabbed regions compensating for thermal expansion and contraction; and, wherein tabbed regions of abutting ring ends abut one another and laterally seal the ring ends.

11. An improved head adapted to be secured to an internal combustion engine of the type comprising a rigid block, a primary crankshaft rotatably disposed within said block, at least one cylinder defined in said block, at least one power piston driven by said crankshaft and reciprocated within said at least one cylinder, the head comprising:

means for attaching the head to said block over said at least one piston;

at least one pair of exhaust ports formed in said head adapted to be disposed proximate said piston;

at least one pair of intake ports formed in said head adapted to be disposed proximate said piston;

an elongated, tubular exhaust tunnel disposed in said head proximate said head exhaust ports, said exhaust tunnel adapted to be oriented transversely with respect to said cylinder;

a tubular exhaust sleeve disposed within said exhaust tunnel and in fluid flow communication therewith, the exhaust sleeve comprising a pair of exhaust ports generally aligned with said head exhaust ports;

an elongated, tubular intake tunnel disposed in said head proximate said head intake ports, said intake tunnel adapted to be oriented transversely with respect to said cylinder;

a tubular intake sleeve disposed within said intake tunnel and in fluid flow communication therewith, the intake sleeve comprising a pair of intake ports generally aligned with said head intake ports;

a tubular, sliding exhaust valve disposed within said exhaust sleeve, said exhaust valve comprising an exhaust gas port and an elongated internal tubular passageway in fluid flow communication with said valve exhaust gas port for exhausting gases and a plurality of coaxially mounted, spaced apart sealing rings;

a tubular, sliding intake valve disposed within said intake sleeve, said intake valve comprising an intake gas port and an elongated, internal tubular passageway in fluid flow communication with said valve intake gas port for intaking a raw fuel/air mixture and a plurality of coaxially mounted, spaced apart sealing rings;

a slide valve crankshaft rotatably mounted within said head for reciprocating said sliding exhaust and intake valves in response to rotation of said primary crankshaft, such that the exhaust valve gas port is aligned with the exhaust ports in said exhaust sleeve during an exhaust stroke of said piston and otherwise said exhaust valve closes said sleeve and head exhaust ports, and such that the intake valve gas port is aligned with the intake ports in said intake sleeve during an intake stroke of said piston and otherwise said intake valve closes said sleeve and head intake ports;

wherein said slide valve crankshaft has an axis of rotation oriented generally perpendicularly with respect to said slide valves;

valve connecting rods mechanically connecting said slide valve crankshaft with said sliding intake and sliding exhaust valves; and, wherein the ports forming said at least one pair of exhaust ports in said exhaust sleeve are separated from one another by bridges that contact rings on said exhaust valve, and the ports forming said at least one pair of intake ports in said intake sleeve are separated from one another by bridges that contact rings on said intake valve.

12. The head as defined in claim 11 further comprising a relief annulus defined between a reduced diameter region of each valve and the sleeve in which the valve is slidably disposed to distribute potential shearing pressure about the circumference of the valve.

13. The head as defined in claim 12 wherein said primary crankshaft drives an external drive pulley, said slide valve crankshaft has an axis of rotation parallel with and spaced apart from said primary crankshaft axis of rotation, said slide valve crankshaft has a second pulley, and a belt is entrained about said drive and said second pulleys.

14. The head as defined in claim 11 wherein each of said intake and exhaust ports defined in said head comprises smooth, inclined sidewalls that are polished for maximal fluid flow.

15. The head as defined in claim 11 wherein each exhaust and intake valve comprises an open connecting rod section enabling connection to the valve's connecting rod, and a closed wall that separates the connecting rod section from the valve internal tubular passageway.

16. The head as defined in claim 15 wherein each exhaust and intake valve comprises a port section proximate said closed wall in which the valve ports are defined, an adjacent midsection, and an open section in fluid flow communication with said valve ports.

17. The head as defined in claim 16 wherein each valve port section comprises an arcuate cutout functioning as an aspiration port that radially extends between 30-40 percent around the radial periphery of the valve.

18. The head as defined in claim 16 wherein concentric ring grooves separate each valve rod section from the port section, concentric ring grooves separate each valve port section from the adjacent midsection, and concentric ring grooves separate the valve midsection from the valve open section.

19. The head as defined in claim 18 wherein said sealing rings are coaxially, externally mounted to said valves and seated within said concentric ring grooves.

20. The head as defined in claim 19 wherein the sealing rings are stepped for enhanced compression and comprise:

abutting ring ends with a notched region and a bordering tabbed region;

the tabbed regions variably spaced apart from said notched regions;

end gaps between the notched and tabbed regions compensating for thermal expansion and contraction; and, wherein tabbed regions of abutting ring ends abut one another and laterally seal the ring ends.

21. An internal combustion engine comprising:

a rigid block;

a primary crankshaft rotatably disposed within said block;

at least one cylinder defined in said block;

at least one power piston driven by said crankshaft, said at least one power piston reciprocated within said at least one cylinder;

a head over said at least one piston;

a combustion chamber between said piston and said head;

at least one pair of exhaust ports formed in said head disposed proximate said combustion chamber;

at least one pair of intake ports formed in said head disposed proximate said combustion chamber;

an elongated, tubular exhaust tunnel disposed in said head proximate said head exhaust ports;

an elongated, tubular intake tunnel disposed in said head proximate said head intake ports;

a tubular, sliding exhaust valve disposed within said cylindrical exhaust tunnel in said head, said exhaust valve comprising an exhaust gas port and an elongated internal tubular passageway in fluid flow communication with said valve exhaust gas port for exhausting gases and a plurality of coaxially mounted, spaced apart sealing rings;

a tubular, sliding intake valve disposed within said cylindrical intake tunnel in said head, said intake valve comprising an intake gas port and an elongated, internal tubular passageway in fluid flow communication with said valve intake gas port for intaking a raw fuel/air mixture and a plurality of coaxially mounted, spaced apart sealing rings;

a slide valve crankshaft rotatably mounted within said head for reciprocating said sliding exhaust and intake valves in response to rotation of said primary crankshaft, such that the exhaust valve gas port is aligned with the exhaust ports in said head during an exhaust stroke of said piston and otherwise said exhaust valve closes said head exhaust ports, and such that the intake valve gas port is aligned with the intake ports in said head during an intake stroke of said piston and otherwise said intake valve closes said head intake ports;

wherein said slide valve crankshaft has an axis of rotation oriented generally perpendicularly with respect to said slide valves;

valve connecting rods mechanically connecting said slide valve crankshaft with said sliding intake and sliding exhaust valves; and, wherein the ports forming said at least one pair of exhaust ports in said head are separated from one another by bridges that contact rings on said exhaust valve, and the ports forming said at least one pair of intake ports in said head are separated from one another by bridges that contact rings on said intake valve.

22. The engine as defined in claim 21 further comprising a relief annulus defined between a reduced diameter region of each valve and the passageway in which the valve is slidably disposed to distribute potential shearing pressure about the circumference of the valve.

23. The engine as defined in claim 21 wherein said primary crankshaft drives an external drive pulley, said slide valve crankshaft has an axis of rotation parallel with and spaced apart from said primary crankshaft axis of rotation, said slide valve crankshaft has a second pulley, and a belt is entrained about said drive and said second pulleys.

24. The engine as defined in claim 23 wherein each of said intake and exhaust ports defined in said head comprises smooth, inclined sidewalls that are polished for maximal fluid flow.

25. The engine as defined in claim 21 wherein each exhaust and intake valve comprises an open connecting rod section enabling connection to the valve's connecting rod, and a closed wall that separates the connecting rod section from the internal tubular passageway.

26. The engine as defined in claim 25 wherein each exhaust and intake valve comprises a port section proximate said closed wall in which the valve ports are defined, an adjacent midsection, and an open section in fluid flow communication with said valve ports.

27. The engine as defined in claim 26 wherein each valve port section comprises an arcuate cutout functioning as an aspiration port that radially extends between 30-40 percent around the radial periphery of the valve.

28. The head as defined in claim 26 wherein concentric ring grooves separate each valve rod section from the port section, concentric ring grooves separate each valve port section from the adjacent midsection, and concentric ring grooves separate the valve midsection from the valve open section.

29. The head as defined in claim 28 wherein said sealing rings are coaxially, externally mounted to said valves and seated within said concentric ring grooves.

30. The head as defined in claim 29 wherein the sealing rings are stepped for enhanced compression and comprise:

abutting ring ends with a notched region and a bordering tabbed region;

the tabbed regions variably spaced apart from said notched regions;

end gaps between the notched and tabbed regions compensating for thermal expansion and contraction; and, wherein tabbed regions of abutting ring ends abut one another and laterally seal the ring ends.

31. An internal combustion engine comprising:

a rigid block;

a primary crankshaft rotatably disposed within said block;

at least one cylinder defined in said block;

at least one power piston driven by said crankshaft, said at least one power piston reciprocated within said at least one cylinder;

a head over said at least one piston;

a combustion chamber between said piston and said head;

head exhaust ports formed in said head disposed proximate said combustion chamber;

head intake ports formed in said head disposed proximate said combustion chamber;

an elongated, tubular exhaust tunnel disposed in said head proximate said head exhaust ports, said exhaust tunnel oriented transversely with respect to said cylinder;

a tubular exhaust sleeve disposed within said exhaust tunnel and in fluid flow communication therewith, the exhaust sleeve comprising a pair of exhaust ports generally aligned with said head exhaust ports;

an elongated, tubular intake tunnel disposed in said head proximate said head intake ports, said exhaust tunnel oriented transversely with respect to said cylinder;

a tubular intake sleeve disposed within said intake tunnel and in fluid flow communication therewith, the intake sleeve comprising a pair of intake ports generally aligned with said head intake ports;

a tubular, sliding exhaust valve disposed within said exhaust sleeve, said exhaust valve comprising an exhaust gas port and an elongated internal tubular passageway in fluid flow communication with said valve exhaust gas port for exhausting gases and a plurality of coaxially mounted, spaced apart sealing rings;

a tubular, sliding intake valve disposed within said intake sleeve, said intake valve comprising an intake gas port and an elongated, internal tubular passageway in fluid flow communication with said valve intake gas port for intaking a raw fuel/air mixture and a plurality of coaxially mounted, spaced apart sealing rings;

a slide valve crankshaft rotatably mounted within said head for reciprocating said sliding exhaust and intake valves in response to rotation of said primary crankshaft, such that the exhaust valve gas port is aligned with the exhaust ports in said exhaust sleeve during an exhaust stroke of said piston and otherwise said exhaust valve closes said sleeve and head exhaust ports, and such that the intake valve gas port is aligned with the intake ports in said intake sleeve during an intake stroke of said piston and otherwise said intake valve closes said sleeve and head intake ports;

wherein said slide valve crankshaft has an axis of rotation oriented generally perpendicularly with respect to said slide valves;

valve connecting rods mechanically connecting said slide valve crankshaft with said sliding intake and sliding exhaust valves; and, wherein the ports forming said at least one pair of exhaust ports in said exhaust sleeve are separated from one another by bridges that contact rings on said exhaust valve, and the ports forming said at least one pair of intake ports in said intake sleeve are separated from one another by bridges that contact rings on said intake valve.

32. The engine as defined in claim 31 further comprising a relief annulus defined between a reduced diameter region of each valve and the sleeve in which the valve is slidably disposed to distribute potential shearing pressure about the circumference of the valve.

33. The engine as defined in claim 31 wherein said primary crankshaft drives an external drive pulley, said slide valve crankshaft has an axis of rotation parallel with and spaced apart from said primary crankshaft axis of rotation, said slide valve crankshaft has a second pulley, and a belt is entrained about said drive and said second pulleys.

34. The engine as defined in claim 31 wherein each of said intake and exhaust ports defined in said head comprises smooth, inclined sidewalls that are polished for maximal fluid flow.

35. The engine as defined in claim 31 wherein each exhaust and intake valve comprises an open connecting rod section enabling connection to the valve's connecting rod, and a closed wall that separates the connecting rod section from the internal tubular passageway.

36. The engine as defined in claim 35 wherein each exhaust and intake valve comprises a port section proximate said closed wall in which the valve ports are defined, an adjacent midsection, and an open section in fluid flow communication with said valve ports.

37. The engine as defined in claim 36 wherein each valve port section comprises an arcuate cutout functioning as an aspiration port that radially extends between 30-40 percent around the radial periphery of the valve.

38. The engine as defined in claim 36 wherein concentric ring grooves separate each valve rod section from the port section, concentric ring grooves separate each valve port section from the adjacent midsection, and concentric ring grooves separate the valve midsection from the valve open section.

39. The engine as defined in claim 38 wherein said sealing rings are coaxially, externally mounted to said valves and seated within said concentric ring grooves.

40. The engine as defined in claim 39 wherein the sealing rings are stepped for enhanced compression and comprise:

abutting ring ends with a notched region and a bordering tabbed region;

the tabbed regions variably spaced apart from said notched regions;

end gaps between the notched and tabbed regions compensating for thermal expansion and contraction; and, wherein tabbed regions of abutting ring ends abut one another and laterally seal the ring ends.

* * * * *